US011965352B2

(12) United States Patent
Singh et al.

(10) Patent No.: US 11,965,352 B2
(45) Date of Patent: Apr. 23, 2024

(54) TENT COUPLERS

(71) Applicant: Sea to Summit Pty Ltd, Rivervale (AU)

(72) Inventors: Paramjeet Singh, Rivervale (AU); Roland Tyson, Rivervale (AU); Tom Schilperoort, Rivervale (AU)

(73) Assignee: Sea to Summit Pty Ltd, Rivervale (AU)

( * ) Notice: Subject to any disclaimer, the term of this patent is extended or adjusted under 35 U.S.C. 154(b) by 68 days.

(21) Appl. No.: 17/752,133

(22) Filed: May 24, 2022

(65) Prior Publication Data

US 2022/0381053 A1 Dec. 1, 2022

Related U.S. Application Data

(60) Provisional application No. 63/194,430, filed on May 28, 2021.

(51) Int. Cl.
*E04H 15/64* (2006.01)
*E04H 15/36* (2006.01)
*E04H 15/44* (2006.01)

(52) U.S. Cl.
CPC ..... *E04H 15/64* (2013.01); *E04H 15/36* (2013.01); *E04H 15/44* (2013.01)

(58) Field of Classification Search
CPC ..... E04H 15/64; E04H 15/36; E04H 15/44; A44B 11/2592; A44B 11/2596; Y10T 24/45796; Y10T 24/45267; F16B 21/06
USPC ..... 135/119, 120.3, 120.4; 446/124
See application file for complete search history.

(56) References Cited

U.S. PATENT DOCUMENTS 4,193,413 A * 3/1980 Watts ..... E04H 15/64 24/581.1
5,333,634 A * 8/1994 Taylor ..... E04H 15/425 135/125
5,615,699 A * 4/1997 Lee ..... E04H 15/64 135/118
6,021,795 A * 2/2000 Long ..... E04H 15/42 135/132
6,681,786 B2 * 1/2004 Ju ..... E04H 15/64 135/120.3

(Continued)

*Primary Examiner* — Robert Canfield
(74) *Attorney, Agent, or Firm* — Kolitch Romano Dascenzo Gates LLC

(57) ABSTRACT

Tent couplers include a pivot interlocking member and a bridged interlocking member. The bridged interlocking member comprises a bridge that extends between a tether-receiving portion and a tent support-receiving portion that includes a tent support receiver configured to couple to a tent support. The pivot interlocking member includes a tent fabric receiver configured to couple to a tent fabric. The pivot interlocking member defines a bridge-receiving aperture and an entrance slot interconnected thereto. Tent couplers are selectively configured between a linking configuration and an interlocked configuration. In the linking configuration, the pivot interlocking member is positioned for insertion and removal of the bridge from the bridge-receiving aperture via the entrance slot. In the interlocked configuration, the bridge is positioned within the bridge-receiving aperture, and the pivot interlocking member is oriented within a range of interlocked orientations that restrict removal of the bridge from the bridge-receiving aperture.

20 Claims, 11 Drawing Sheets

(56) References Cited

U.S. PATENT DOCUMENTS

| | | | | |
|---|---|---|---|---|
| 6,966,324 | B2 * | 11/2005 | Guido | E04H 15/64 24/265 AL |
| 8,763,621 | B2 * | 7/2014 | Jin | E04H 15/42 135/156 |
| 10,676,957 | B1 * | 6/2020 | Park | E04H 15/64 |

* cited by examiner

TENT COUPLERS

RELATED APPLICATION

This application claims priority to similarly titled U.S. Provisional Patent Application No. 63/194,430, which was filed on May 28, 2021, and the complete disclosure of which is hereby incorporated by reference.

FIELD

The present disclosure relates to tent couplers, and more specifically to tent couplers configured to selectively transition between interlocked and linking configurations.

BACKGROUND

Tents typically include one or more tent fabrics and one or more tent supports that are assembled to form an assembled tent frame. The assembled tent frame supports the tent on a support surface and supports the one or more tent fabrics above the support surface to surround an internal space. Tents most commonly are used as lightweight portable shelters that may be assembled in one location and subsequently disassembled, transported, and reassembled in another location. Thus, a tent typically is designed so that some or most of its components can be detached from one another, stowed, and then reassembled from a stowed state to an assembled state. Recreational tents, such as camping tents, often include an inner tent fabric that is hung from the assembled tent frame, and an outer tent fabric that extends over at least a portion of the exterior of the assembled tent frame. Depending on the weather or conditions, a camping tent may be assembled with either or both of the inner tent fabric and the outer tent fabric. Often, a user may desire to switch between having the tent assembled with either or both of the tent fabrics, such as if conditions change with time.

Traditionally, tent fabrics are provided with grommeted straps that are used to attach the tent fabric to the feet, or end regions, of the tent supports. In traditional tents, attaching a tent fabric to a tent support typically includes lifting the tent support and inserting the end region of the tent support into a corresponding grommet. This process often requires use of two hands and may be repeated several times depending on the number of tent supports included in the tent. Generally, when a conventional tent is assembled with both tent fabrics, the grommeted straps of the two tent fabrics are attached to the foot of a tent support, one on top of the other. Thus, in situations where it is desired to detach one of the tent fabrics while leaving the other one attached, a user often must disconnect both tent fabrics from the tent support and then reattach the desired tent fabric. Needless to say, whether assembling, dissembling, or reconfiguring traditional tents, the process of coupling and/or decoupling the one or more tent fabrics to the tent supports often is cumbersome, can demand significant dexterity, and/or requires simultaneous use of both of a user's hands. Thus, a need exists for improved tent couplers for selectively coupling one or more tent fabrics to the tent supports of a tent and that may allow for two tent fabrics of the tent to be selectively coupled to and decoupled from the tent supports independently of one another.

SUMMARY

Tent couplers, tents including tent couplers, and associated methods are disclosed herein. The tent couplers are configured to selectively interconnect a tent fabric and a tent support of a tent to one another. The tent couplers include a bridged interlocking member and a pivot interlocking member. The bridged interlocking member includes a tent support-receiving portion that includes a tent support receiver configured to selectively couple to the tent support. The bridged interlocking member also includes a tether-receiving portion and a bridge that extends between and supports the tent support-receiving portion and the tether-receiving portion spaced apart from one another. The bridge defines a bridge width that is less than a width of each of the tent support-receiving portion and the tether-receiving portion. The pivot interlocking member includes a tent fabric receiver configured to interconnect with a tent fabric. The pivot interlocking member defines a bridge-receiving aperture that extends through a thickness of the pivot-interlocking member and that is configured to selectively receive the bridge of the bridged interlocking member. The pivot interlocking member also includes an entrance slot that is interconnected with the bridge-receiving aperture and that is configured to permit selective movement of the bridge into and out of the bridge-receiving aperture.

The tent couplers may be selectively configured between a linking configuration and an interlocked configuration. In the linking configuration, the pivot interlocking member is positioned and oriented relative to the bridge for translation of the bridge into and from the bridge-receiving aperture via the entrance slot. In the interlocked configuration, the bridge is positioned within the bridge-receiving aperture, and the pivot interlocking member is oriented within a range of interlocked orientations about the bridge that restrict removal of the bridge from the bridge-receiving aperture through the entrance slot.

The tents include a plurality of tent supports configured to be assembled to form an assembled tent frame. The tents also include an inner tent fabric and/or an outer tent fabric. The tents further include a plurality of tent connectors, each of which is configured to selectively couple the inner tent fabric and/or the outer tent fabric to a respective tent support of the plurality of tent supports.

The methods include connecting the tent fabric to the tent support, which includes positioning the pivot interlocking member adjacent to the bridge of the bridged interlocking member with the pivot interlocking member interconnected to the tent fabric and the bridged interlocking member coupled to the tent support, orienting the pivot interlocking member in a linking orientation relative to the bridge, moving the pivot interlocking member in the linking orientation relative to the bridge to translate the bridge through the entrance slot and into the bridge-receiving aperture, and pivoting the pivot interlocking member while the bridge is positioned within the bridge-receiving aperture from the linking orientation to within the range of interlocked orientations.

DRAWINGS

DETAILED DESCRIPTION

Figure 1:
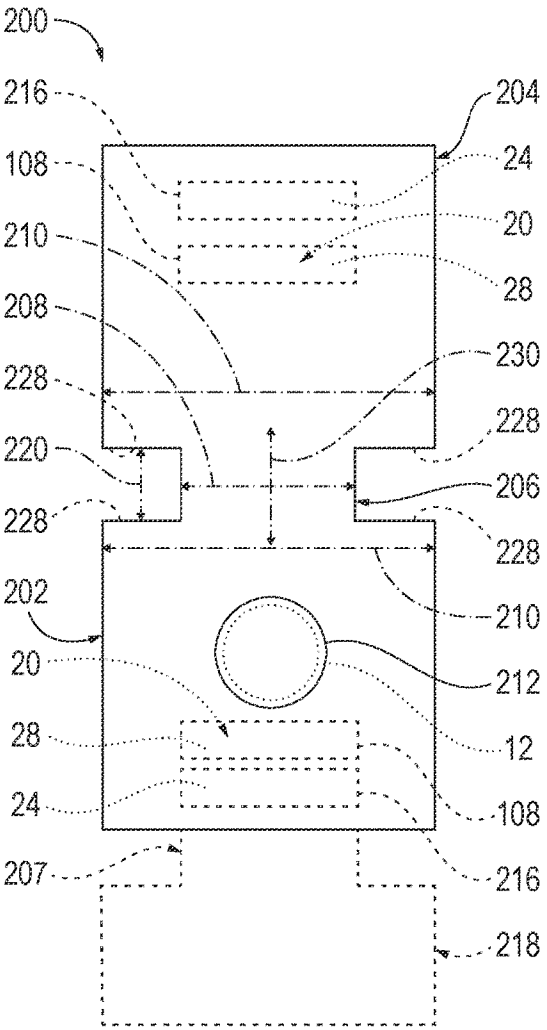
FIG. 1 is an exploded plan view schematically illustrating examples of tent couplers according to the present disclosure.
Figure 1:
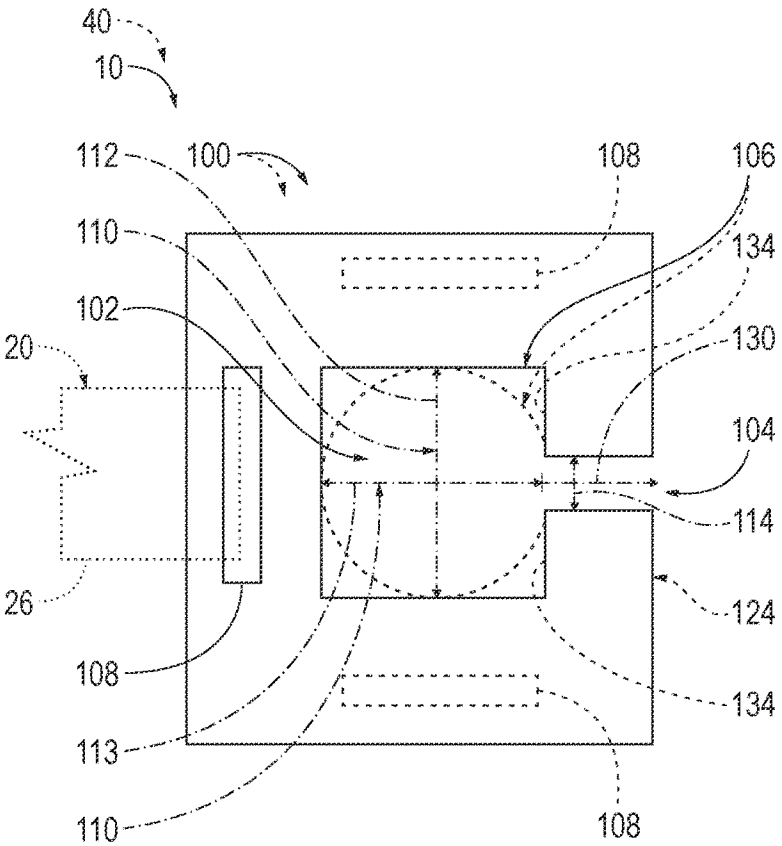

Herein after, examples of tent couplers, tents, and methods of using the same according to the present disclosure that are disclosed herein will be described in detail with reference to the accompanying drawings, in which identical or similar reference numbers are given to identical or similar elements, and an overlapping description is omitted herein. FIGS. 1-14 provide examples of tent couplers, of tents that include tent couplers, and of methods of utilizing the same according to the present disclosure. Elements that serve a similar, or at least substantially similar, purpose are labelled with like numbers in each of FIGS. 1-14, and these elements may not be discussed in detail herein with reference to each of FIGS. 1-14. Similarly, all elements may not be labelled in each of FIGS. 1-14, but reference numbers associated therewith may be utilized herein for consistency. Elements, components, and/or features that are discussed herein with reference to one or more of FIGS. 1-14 may be included in and/or utilized with any of FIGS. 1-14 without departing from the scope of the present disclosure.

Generally, in the drawings, elements that are likely to be included in a given example are illustrated in solid lines, while elements that are optional or alternatives are illustrated in dashed lines. However, elements that are illustrated in solid lines are not essential to all embodiments of the present disclosure, and an element shown in solid lines may be omitted from a particular embodiment without departing from the scope of the present disclosure. In schematic FIGS. 1-5, dot-dashed lines are utilized to indicate virtual features that may be defined by tent couplers 10, and/or components thereof, such as dimensions, orientations, etc., and dotted lines are utilized to indicate features and/or structure that may be environment to and/or utilized in conjunction with tent couplers 10 and/or tents 40 according to the present disclosure.

Figure 2:
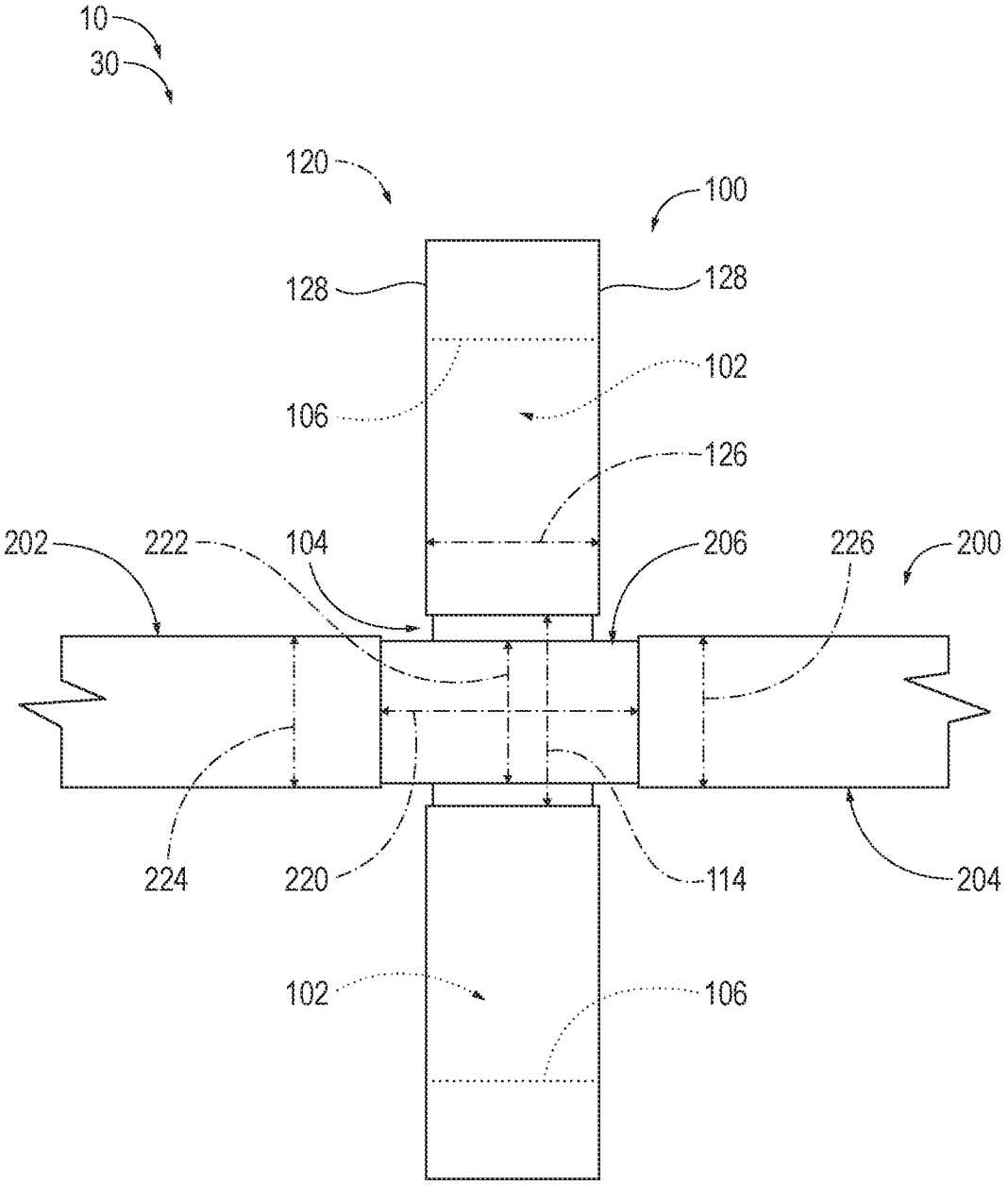
FIG. 2 is a fragmentary view schematically illustrating examples of tent couplers in a linking configuration according to the present disclosure.
Figure 3:
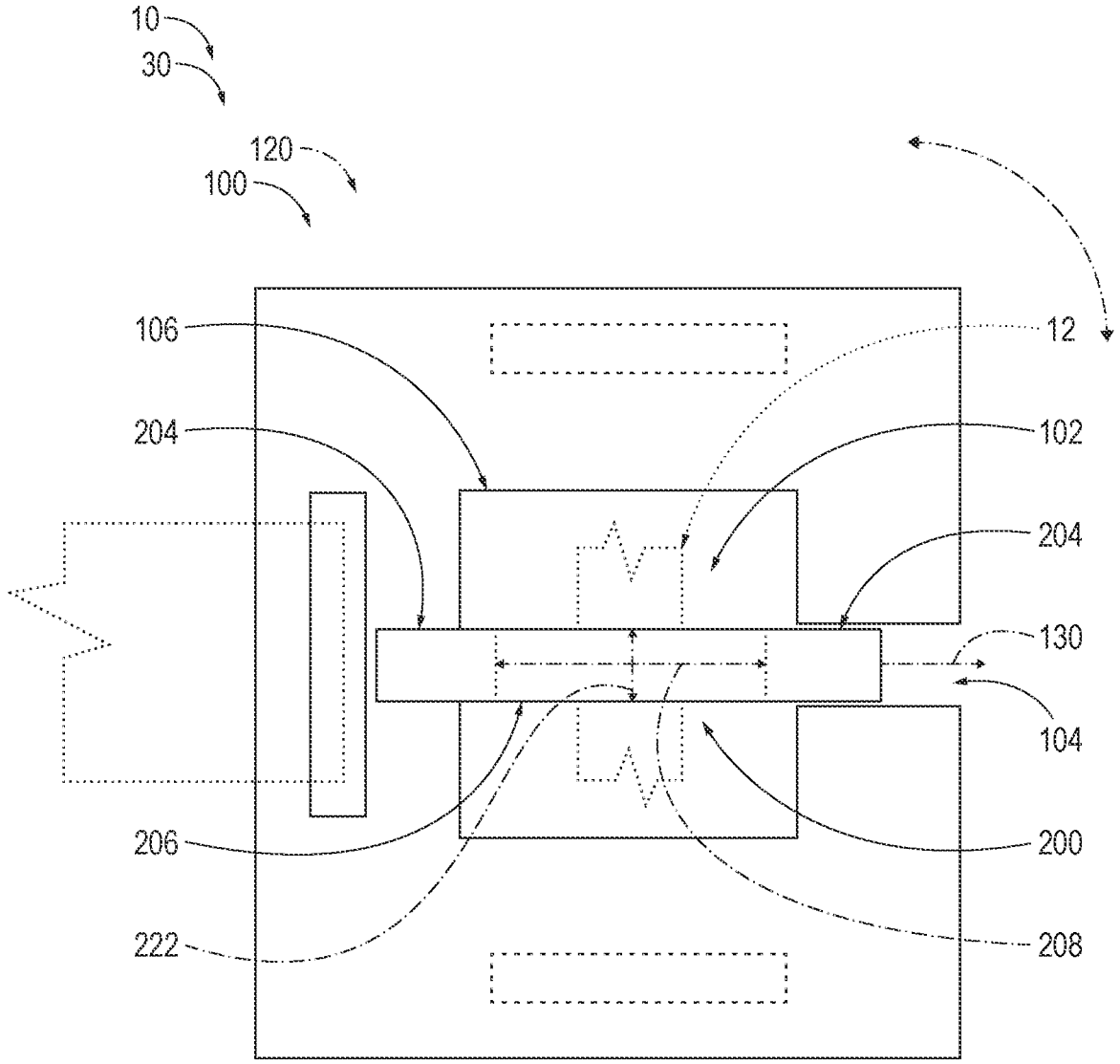
FIG. 3 is a fragmentary end view schematically illustrating examples of tent couplers in the linking configuration according to the present disclosure.
Figure 4:
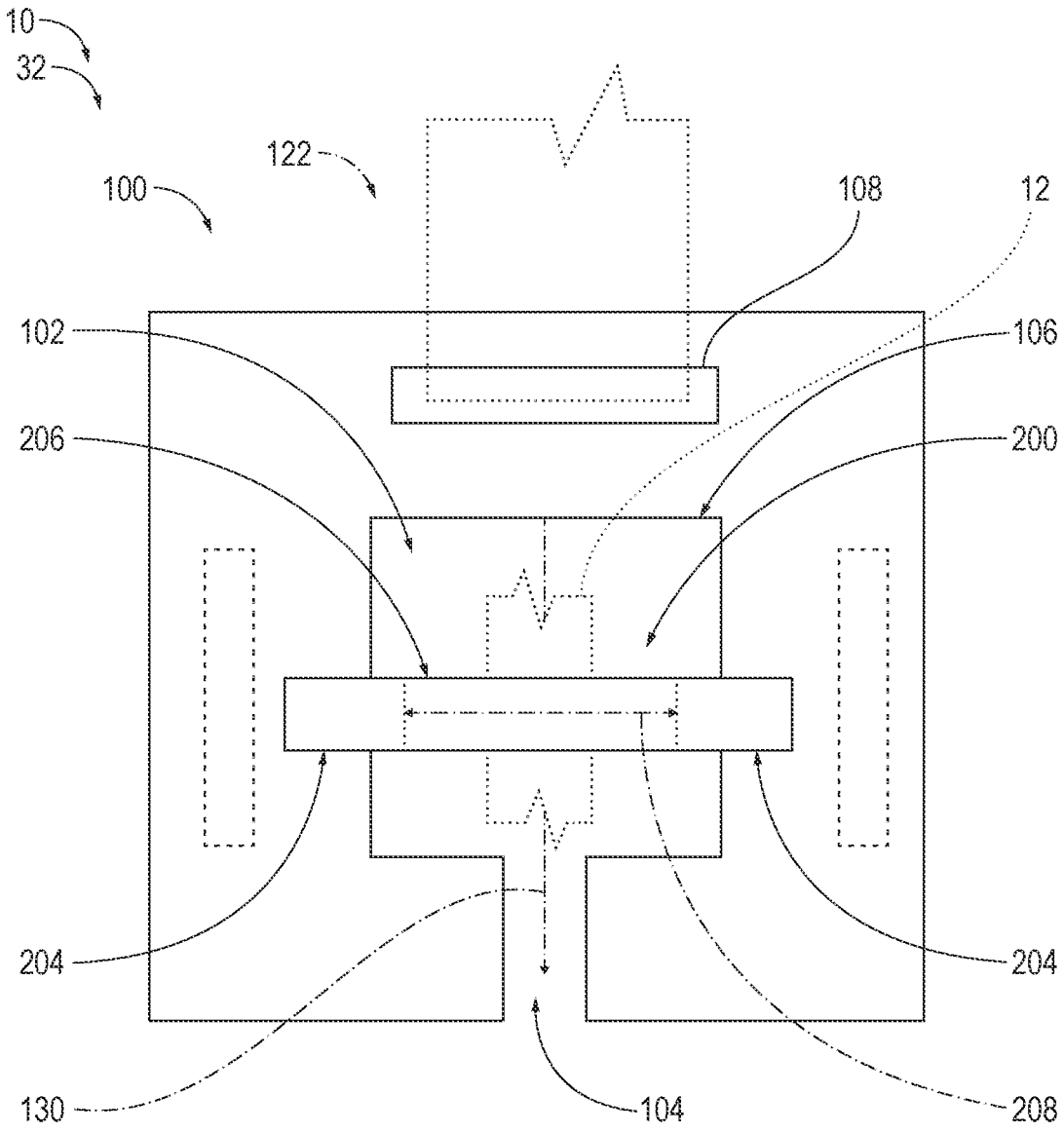
FIG. 4 is a fragmentary end view schematically illustrating examples of tent couplers in an interlocked configuration according to the present disclosure.

FIG. 1 is a schematic plan view showing examples of tent couplers 10 according to the present disclosure. FIG. 2 is a schematic view showing examples of tent couplers 10 in a linking configuration 30, FIG. 3 is a schematic view showing examples of tent couplers 10 in the linking configuration, and FIG. 4 is a schematic view showing examples of tent couplers 10 in an interlocked configuration 32 according to the present disclosure. With reference to FIGS. 1-4, tent couplers 10 are configured to selectively interconnect a tent fabric 20 of a tent 40 to a tent support 12 of tent 40. Tent couplers 10 include a bridged interlocking member 200 and a pivot interlocking member 100 that are configured to selectively form an interlock with one another. Bridged interlocking member 200 includes a tent support-receiving portion 202 having a tent support receiver 212 that is configured to selectively couple to tent support 12. Bridged interlocking member 200 also includes a tether-receiving portion 204 and a bridge 206 that extends between and supports tent support-receiving portion 202 and tether-receiving portion 204 spaced apart from one another. As discussed in more detail herein, tether-receiving portion 204 may be configured to interconnect with a tether that attaches bridged interlocking member 200 to a portion of tent 40, such as a tent fabric and/or a guy line.

Bridge 206 defines a bridge width 208 that is less than a width 210 of each of tent support-receiving portion 202 and tether-receiving portion 204. In other words, bridged interlocking member 200 may be described as having a recess or taper that partially separates tent support-receiving portion 202 and tether-receiving portion 204 and that defines bridge 206. The recess formed between tent support-receiving portion 202 and tether-receiving portion 204 may be symmetrical, or at least substantially symmetrical, relative to width 210, although this is not required in all examples of the present disclosure. In view of the above, bridge 206 additionally or alternatively may be referred to as a tapered portion, a recessed portion, a narrowed portion, and/or a neck. Bridged interlocking member 200 additionally or alternatively may be referred to as an I-shaped interlocking member 200.

Pivot interlocking member 100 includes a tent fabric receiver 108 configured to interconnect with tent fabric 20. Pivot interlocking member 100 defines a bridge-receiving aperture 102 that extends through a thickness 126 of pivot interlocking member 100 and that is configured to selectively receive bridge 206 of bridged interlocking member 200. Pivot interlocking member 100 also defines an entrance slot 104 that is interconnected with bridge-receiving aperture 102. Entrance slot 104 is configured to permit selective movement of bridge 206 into and out of bridge-receiving aperture 102. In particular, pivot interlocking member 100 may include an interior sidewall 106 that defines bridge-receiving aperture 102 and an exterior sidewall 124 that defines an exterior of pivot interlocking member 100. Entrance slot 104 may extend through exterior sidewall 124 and through interior sidewall 106 to define a passage from bridge-receiving aperture 102 through the exterior of pivot interlocking member 100. Pivot interlocking member 100 additionally or alternatively may be referred to as a C-shaped interlocking member 200.

As perhaps best seen in FIGS. 2-4, tent couplers 10 are designed to be selectively configured between a linking configuration 30 (shown in FIG. 3) and an interlocked configuration 32 (shown in FIG. 4). In linking configuration 30, pivot interlocking member 100 is positioned and oriented relative to bridged interlocking member 200 for translation of bridge 206 into and from bridge-receiving aperture 102 via entrance slot 104. In interlocked configuration 32, bridge 206 is positioned within bridge-receiving aperture 102, and pivot interlocking member 100 is oriented within a range of interlocked orientations 122 about bridge 206 that restrict removal of bridge 206 from bridge-receiving aperture 102 via entrance slot 104. Put in slightly different terms, bridge-receiving aperture 102 of pivot interlocking member 100 may be moved onto and removed from bridge 206 via entrance slot 104 in linking configuration 30. In interlocked configuration 32, pivot interlocking member 100 and bridge interlocking member 200 create an interlock that restricts pivot interlocking member 100 and bridge interlocking member 200 from being separated by relative translation of these members. Instead, pivot interlocking member 100 and bridge interlocking member 200 only may be separated by pivoting, or rotating, relative to each other to configure the tent coupler back to linking configuration 30.

In view of the above, tent coupler 10 may selectively interconnect tent fabric 20 to tent support 12 when tent support receiver 212 of bridged interlocking member 200 receives and is engaged with tent support 12, pivot interlocking member 100 is interconnected with tent fabric 20, and tent coupler 10 is in interlocked configuration 32. Tent coupler 10 also may be configured to selectively bring tent fabric 20 into interconnection with tent support 12 and selectively disconnect tent fabric 20 from tent support 12 when tent support receiver 212 of bridged interlocking member 200 receives and is engaged with tent support 12, pivot interlocking member 100 is interconnected with tent fabric 20, and tent coupler 10 is in linking configuration 30.

Typically, tents 40 include a plurality of tent supports 12 that are assembled to form an assembled tent frame. With this in mind, tents 40 according to the present disclosure may include a plurality of tent couplers 10 to selectively couple tent fabric 20 to at least some of tent supports 12, and optionally each tent support 12, included in tent 40. With bridged interlocking member 200 coupled to tent support 12, pivot interlocking member 100 may be selectively interlocked with bridged interlocking member 200 through a one-handed operation or without requiring the user to grab or otherwise manipulate tent support 12. Thus, tent coupler 10 may allow tent fabric 20 to be selectively coupled to and selectively decoupled from the assembled tent frame through a series of simple one-handed operations.

In linking configuration 30, pivot interlocking member 100 is oriented in a linking orientation 120 about and/or relative to bridge 206. Linking orientation 120 is different from and/or outside of the range of interlocking orientations 122. In linking configuration 30, entrance slot 104 of pivot interlocking member 100 may be positioned directly adjacent to bridge 206 and/or laterally between tent support-receiving portion 202 and tether-receiving portion 204 of bridged interlocking member 200. As more specific examples, pivot interlocking member 100 may define an aperture axis 132 that extends centrally through bridge-receiving aperture 102 and parallel with thickness 126 of pivot interlocking member 100. Pivot interlocking member 100 also may define a linking axis 130 that extends perpendicularly through aperture axis 132 and centrally through entrance slot 104. In linking orientation 120, linking axis 130 of pivot interlocking member 100 may be parallel to, or at least substantially parallel to, bridge width 208. By contrast, when tent coupler 10 is in interlocked configuration 32 and pivot interlocking member 100 is oriented within the range of interlocked orientations 122, linking axis 130 of pivot interlocking member 100 may be between oblique to and perpendicular to bridge width 208 of bridge 206. That said, in both linking configuration 30 and in interlocked configuration 32, linking axis 130 of pivot interlocking member 100 may extend between, or extend in a direction that is between, tent support-receiving portion 202 and tether-receiving portion 204 of bridged interlocking member 200. Stated another way, tent support-receiving portion 202 and tether-receiving portion 204 of bridged interlocking member 200 may extend adjacent to opposed faces 128 of pivot interlocking member 100 when bridge 206 is positioned within bridge-receiving aperture 102.

Tent couplers 10 are configured to be selectively transitioned between interlocked configuration 32 and linking configuration 30. In particular, selective transition of tent coupler 10 between interlocked configuration 32 and linking configuration 30 may provide selective attachment and selective detachment of tent fabric 20 to and from tent support 12. When bridge 206 is positioned within bridge-receiving aperture 102, pivot interlocking member 100 may be configured to pivot about bridge 206 among linking orientation 120 and the range of interlocked orientations 122. Thus, pivot interlocking member 100 may be configured to selectively pivot about bridge 206 to selectively transition tent coupler 10 between linking configuration 30 and interlocking configuration 32. As more specific examples, bridge 206 may define a central axis 230 that extends through a center of bridge width 208, perpendicular to bridge width 208, and between tent support-receiving portion 202 and tether-receiving portion 204. Pivot interlocking member 100 may be configured to pivot about central axis 230 when bridge 206 is received in bridge-receiving aperture 102 to transition between linking orientation 120 and the range of interlocked orientations 122. In particular, pivot interlocking member 100 may be configured to pivot in clockwise and/or counterclockwise directions about bridge between linking orientation 120 and the range of interlocked orientations 122.

Pivot interlocking member 100 may be configured to pivot through any suitable angle about central axis 230 of bridge 206 to transition from linking orientation 120 to the range of interlocked orientations 122 and vice versa. As discussed in more detail herein, the angle through which pivot interlocking member 100 is pivoted to transition between linking orientation 120 and the range of interlocked orientations 122 may be determined by various dimensions of bridge 206 and pivot interlocking member 100 relative to one another. More specific examples of a magnitude of the angle through which pivot interlocking member 100 is pivoted to transition between linking orientation 120 and the range of interlocked orientations 122 include at least 5°, at least 10°, at least 20°, at least 30°, at least 45°, at least 60°, at most 10°, at most 20°, at most 30°, at most 45°, at most 60°, at most 70°, and/or at most 90°. In some examples, the range of interlocked orientations 122 comprises a principle interlocked orientation in which pivot interlocking member 100 is pivoted farthest from linking orientation 120. For some configurations of tent coupler 10, pivot interlocking member 100 is pivoted through 90° in a clockwise or counterclockwise direction about central axis 230 from linking orientation 120 to the principle interlocked orientation.

Bridge-receiving aperture 102 may be formed with any suitable shape. More specifically, bridge-receiving aperture 102 may surround an open-ended volume having any suitable cross-sectional shape as taken normal to aperture axis 132. As examples, bridge-receiving aperture 102 may include a circular, ovoid, polygonal, rectangular, and/or irregular cross-sectional shape.

As best seen in FIG. 1, bridge-receiving aperture 102 of pivot interlocking member 100 defines an aperture diameter 110 that is measured through aperture axis 132 and between opposing portions of interior sidewall 106. Depending on the shape of bridge-receiving aperture 102, aperture diameter 110 of bridge-receiving aperture 102 may or may not be uniform with respect to rotation about aperture axis 132 or for all angles about aperture axis 132. For example, aperture diameter 110 may be uniform with respect to rotation about aperture axis 132 when bridge-receiving aperture 102 is cylindrical or incudes a circular cross-sectional shape. By contrast, aperture diameter 110 may vary with respect to rotation about aperture axis 132 for examples in which bridge-receiving aperture 102 includes a non-circular cross-sectional shape, such as an ovoid, polygonal, and/or rectangular cross-sectional shape. When aperture diameter 110 of bridge-receiving aperture varies with respect to rotation about aperture axis 132, bridge-receiving aperture 102 may be described as defining a plurality of different aperture diameters 110.

As more specific examples, bridge-receiving aperture 102 may define an aperture length 113 and an aperture width 112 that may be of the same or different magnitudes. Aperture length 113 may be measured along linking axis 130 between the portion of interior sidewall 106 that is directly opposed to entrance slot 104 and a central point of the intersection of entrance slot 104 with bridge-receiving aperture 102. Aperture width 112 may be measured as aperture diameter 110 perpendicular to aperture length 113 and/or parallel to a slot width 114 of entrance slot 104. In this way, bridge width 208 may be parallel to, or at least substantially parallel to, aperture length 113 when pivot interlocking member 100 is in linking orientation 120 about bridge 206. When pivot interlocking member 100 is pivoted from linking orientation 120 towards or into the range of interlocked orientations 122, bridge width 208 may be moved towards alignment with aperture width 112.

To permit pivotal movement of pivot interlocking member 100 about bridge 206, bridge-receiving aperture 102 may be dimensioned such that aperture diameter 110 of bridge-receiving aperture 102 is greater than bridge width 208. For example, bridge-receiving aperture 102 may include an aperture diameter 110 that, at least for some angles about aperture axis 132, is a threshold fraction of bridge width 208. Examples of this threshold fraction include at least 100%, at least 102%, at least 105%, at least 110%, at least 120%, at most 105%, at most 110%, at most 120%, at most 130%, at most 140%, and/or at most 150%.

More specifically, aperture diameter 110 of bridge-receiving aperture 102 may be greater than bridge width 208 through at least a threshold minimum angle of rotation from aperture length 113. Examples of the threshold minimum angle include at least 20°, at least 30°, at least 40°, at least 50°, at least 60°, at least 70°, at least 80°, most 80° and/or at most 90° in either or both of the clockwise and counter-clockwise directions. Thus, in some examples, aperture diameter 110 of bridge-receiving aperture 102 is greater than bridge width 208 for all angles about aperture axis 132. This may permit pivot interlocking member 100 to pivot freely through any angle about bridge 206. Alternatively, bridge-receiving aperture 102 may be dimensioned such that aperture diameter 110 closely corresponds to, or is slightly less than, bridge width 208 for some angles about aperture axis 132. In such an example, interior sidewall 106 may engage, resiliently engage, and/or frictionally engage bridge 206 when pivot interlocking member 100 is pivoted to within certain angles about bridge 206. Such angles may be selected to correspond to the range of interlocked orientations 122, such that engagement of interior sidewall 106 with bridge 206 may aid in selectively and releasably retaining pivot interlocking member 100 within the range of interlocked orientations 122 on bridge 206.

When tent coupler 10 is in interlocked configuration 32, interior sidewall 106 of pivot interlocking member 100 may engage bridge 206 of bridged interlocking member 200 to prevent bridge 206 from being removed from bridge-receiving aperture 102 via entrance slot 104. For example, interior sidewall 106 of pivot interlocking member 100 may include slot-adjacent portions 134 that extend from either side of entrance slot 104. In interlocked configuration 32, either or both slot-adjacent portions 134 may engage bridge 206 to prevent bridge 206 from being removed from bridge-receiving aperture 102 via entrance slot 104. With this in mind, each aperture diameter 110 of bridge-receiving aperture 102 may be greater than slot width 114 of entrance slot 104. Likewise, bridge width 208 of bridge 206 may be greater than slot width 114 of entrance slot 104.

As referred to herein, a first structure being described as engaging a second structure to prevent translation of the first structure relative to the second structure does not necessarily mean the first structure and second structure are always engaged with one another but rather that these structures are engaged to restrict relative translation. As a more specific example, interior sidewall 106 engaging bridge 206 to restrict removal of bridge 206 from bridge-receiving aperture 102 does not necessarily indicate that interior sidewall 106 is engaged with bridge 206 at all times in interlocking configuration 32. Rather, this means that interior sidewall 106 engages bridge 206 against movement of bridge 206 from bridge-receiving aperture 102 in interlocked configuration 32. In other words, bridge 206 may have some degree of translational freedom within bridge-receiving aperture 102 in interlocked configuration 32.

As seen in FIG. 1, slot width 114 is measured normal to linking axis 130. As seen in FIG. 2, slot width 114 is measured normal to the thickness 126 of pivot interlocking member 100. Entrance slot 104 may be dimensioned such that the smallest aperture diameter 110 of bridge-receiving aperture 102 is a threshold fraction of slot width 114. Examples of the threshold fraction of the smallest aperture diameter 110 of bridge-receiving aperture 102 to slot width 114 include at least 110%, at least 125%, at least 150%, at least 175%, at least 200%, at least 225%, at least 250%, at least 300%, at most 150%, at most 175%, at most 200%, at most 225%, at most 250%, at most 300%, and/or at most 350%.

With continued reference to FIGS. 1-4, pivot interlocking member 100 may be dimensioned to at least partially fit within the recess formed between tent support-receiving portion 202 and tether-receiving portion 204 when bridge 206 of bridged interlocking member 200 is positioned within bridge-receiving aperture 102. With this in mind, pivot interlocking member 100 may be dimensioned such that thickness 126 thereof is less than, and/or closely corresponds to, a bridge length 220 of bridge 206. As seen in FIG. 1, bridge length 220 may be measured parallel to central axis 230 of bridge 206. Bridge length 220 may be equivalent to the separation between tent support-receiving portion 202 and tether-receiving portion 204.

Pivot interlocking member 100 may include a pair of opposed faces 128 between which interior sidewall 106 and exterior sidewall 124 extend, and thickness 126 of pivot interlocking member 100 may be measured between opposed faces 128. In some examples, tent support-receiving portion 202 and tether-receiving portion 204 are configured to engage opposed faces 128 of pivot interlocking member 100 to prevent pivot interlocking member from tilting or translating from bridge 206 in interlocked configuration 32. Tent support-receiving portion 202 and tether-receiving portion 204 also may be configured to guide pivotal movement of pivot interlocking member 100 about bridge 206, at least in part by engaging opposed faces 128.

More specifically, as perhaps best shown in FIG. 1, tent support-receiving portion 202 and tether-receiving portion 204 may form two pairs of opposed abutting surfaces 228 that are positioned on either side of bridge 206 and that extend outwardly beyond bridge width 208. Abutting surfaces 228 of a pair face one another and are spaced apart by bridge 206. When bridge 206 is positioned within bridge-receiving aperture 102 and pivot interlocking member 100 is oriented within the range of interlocked orientations 122, abutting surfaces 228 may be positioned closely adjacent to opposed faces 128 of pivot interlocking member 100. In such a configuration, abutting surfaces 228 may engage opposed faces 128 of pivot interlocking member 100 to prevent pivot interlocking member 100 from titling about bridge 206 and/or from translating off of bridge 206 in interlocked configuration 32. Abutting surfaces 228 of bridged interlocking member 200 also may contact opposed faces 128 of pivot interlocking member 100 to guide pivotal movement of pivot interlocking member 100 about bridge 206. In view of the above, each aperture diameter 110 of bridge-receiving aperture 102 may be less than width 210 of tent support-receiving portion 202 and width 210 of tether-receiving portion 204. As another example, the combined length of aperture length 113 and entrance slot 104, as measured along linking axis 130, also may be less than width 210 of tent support-receiving portion 202 and of tether-receiving portion 204.

Bridge 206 may be formed with any suitable shape that extends between tent support-receiving portion 202 and tether-receiving portion 204 and that may permit bridge 206 to selectively form an interlock with pivot interlocking member 100, as discussed herein. Generally speaking, the cross-sectional shape of bridge 206 taken normal to central axis 230 is non-circular such that pivotal movement of pivot interlocking member 100 about bridge 206 may transition tent coupler 10 between linking configuration 30 and interlocked configuration 32. As more specific examples, the cross-sectional shape of bridge 206 taken normal to central axis 230 may be polygonal, rectangular, ovoid, rectangular with rounded lateral sides, and/or a flattened hexagon. In any such example, the largest dimension of the cross-sectional shape of bridge 206 may be along or parallel to bridge width 208.

As perhaps best seen in FIGS. 2 and 3, bridge 206 of bridged interlocking member 200 includes a bridge thickness 222 that is measured perpendicular to bridge length 220 and perpendicular to bridge width 208. Bridge 206 and entrance slot 104 may be dimensioned relative to one another such that bridge thickness 222 is less than slot width 114 to permit movement of bridge 206 into and out of bridge-receiving aperture 102 via entrance slot 104. In some examples, bridge 206 and entrance slot 104 are dimensioned relative to one another such that slot width 114 is a threshold fraction of bridge thickness 222. Examples of this fraction include at least 100%, at least 101%, at least 105%, at least 110%, at least 120%, least 150%, at most 105%, at most 110%, at most 120%, at most 150%, and/or at most 200%.

The ratio of slot width 114 to bridge thickness 222 may at least partially determine the range of interlocked orientations 122 of pivot interlocking member 100 about bridge 206. More specifically, the range of interlocked orientations 122 may be larger for examples in which entrance slot 104 and bridge thickness 222 are dimensioned such that slot width 114 and bridge thickness 222 closely correspond to one another or such that the threshold fraction of slot width 114 to bridge thickness 222 approaches 100% from above. In such examples, with bridge 206 positioned within bridge-receiving aperture 102, pivoting pivot interlocking member 100 through relatively a small angle (e.g., less than 10°) about bridge 206 from linking orientation 120 will position slot-adjacent portions 134 of interior sidewall 106 of pivot interlocking member 100 to restrict movement of bridge 206 from bridge-receiving aperture 102. In other words, pivot interlocking member 100 may be pivoted through a relatively small angle to transition tent coupler 10 from linking configuration 30 to interlocked configuration 32 when slot width 114 and bridge thickness 222 closely correspond to one another. As such, the range of interlocked orientations 122 of pivot interlocking member 100 about bridge 206 may decrease as the magnitude of slot width 114 is increased relative to bridge thickness 222. In view of the above, linking orientation 120 additionally or alternatively may be regarded as a range of linking orientations 120, and the range of linking orientations may decrease as the magnitude of bridge thickness 222 is increased relative to slot width 114.

While bridge 206 may be dimensioned such that bridge thickness 222 is less than slot width 114, tent support-receiving portion 202 and/or tether-receiving portion 204 may be dimensioned such that a thickness thereof is greater than slot width 114 and/or bridge thickness 222. Such a configuration may assist in preventing pivot interlocking member from tilting about bridge 206 and/or translating off of bridge 206 in interlocked configuration 32, such as discussed in connection with abutting surfaces 228. However, this feature is not required of all tent couplers 10 according to the present disclosure.

Further in view of the above, bridge 206 may be dimensioned such that bridge width 208 is greater than bridge thickness 222. In this way, with bridge 206 positioned within bridge-receiving aperture 102, the projected dimension of bridge 206 onto entrance slot 104 increases, and ultimately extends beyond, entrance slot 104 as pivot interlocking member 100 is pivoted towards and into interlocked orientations 122 from linking orientation 120. Such a configuration may increase the range of interlocked orientations 122 relative to a configuration in which bridge width 208 is equivalent to bridge thickness 222. Such a configuration also may increase the overlap of bridge 206 and pivot interlocking member 100 in interlocked configuration 32, which may provide a stronger and/or more versatile interlock therebetween.

To interconnect bridged interlocking member 200 and pivot interlocking member 100, entrance slot 104 and bridge-receiving aperture 102 may be moved onto bridge 206 from either lateral side of bridge 206. The lateral sides of bridge 206 may be defined herein as the sides of bridge 206 between which bridge width 208 extends. Thus, pivot interlocking member 100 may be described as having two linking orientations 120 about bridge 206 that includes a first linking orientation 120 and a second linking orientation 120. When bridge-receiving aperture 102 is received on bridge 206, the first and second linking orientations 120 may bound the range of interlocked orientations 122. In other words, the range of interlocked orientations 122 may be defined by pivotal angles of pivot interlocking member 100 about bridge 206 that are between those of the first and second linking orientations 120. Thus, in some examples, pivot interlocking member may be pivoted through 180° about central axis 230 of bridge 206 between the first and second linking orientations 120.

Pivot interlocking member 100 and bridged interlocking member 200 may be formed from any suitable one or more materials that may be the same as or different from one another. Examples of suitable materials that may be utilized to form pivot interlocking member 100 and/or bridged interlocking member 200 include a polymeric material, a plastic, a resilient material, a metal, a metal alloy, a lightweight metal, and/or aluminum.

Tent fabric receiver 108 of pivot interlocking member 100 may be configured to interconnect with tent fabric 20 in any suitable manner. In some examples, tent fabric receiver 108 is configured to selectively couple with and decouple from tent fabric 20. Tent fabric receiver 108 may be configured to interconnect with tent fabric 20 via any suitable structure or mechanism, examples of which include a tether, a strap, a clip, an adjustable strap, and/or a cord. Tent fabric receiver 108 may be disposed along any suitable region of pivot interlocking member 100, such as along a region of pivot interlocking member 100 that is adjacent to, or opposed to entrance slot 104. As shown in FIG. 4, for examples in which tent fabric receiver 108 is disposed along a region of pivot interlocking member 100 that is opposed to entrance slot 104, upward tension from tent fabric 20 may aid in retaining pivot interlocking member 100 within the range of interlocked orientations 122 about bridge 206 and/or in the principle interlocked orientation.

Tent support receiver 212 of bridged interlocking member 200 also may be configured to selectively couple with tent support 12 in any suitable manner. As examples, tent support receiver 212 may include a bore, a hook, a latch, a friction fit, and/or a clip that is configured to engage tent support 12 and selectively couple and/or retain bridged interlocking member 200 in connection with tent support 12. Tent support receiver 212 may be configured to engage with a specific type of tent support 12 and/or a specific region of tent support 12. For example, tent support 12 may be or include a tent pole, and tent support receiver 212 may be configured to selectively couple to the tent pole. As a more specific example, an end region, such as a ground-contacting end region, of the tent pole may include a cylindrical or otherwise geometrically shaped recess, and tent support receiver 212 may be configured to selectively couple to the cylindrical or otherwise geometrically shaped recess of the tent pole. When received in tent support receiver 212, tent support 12 may extend at least substantially normal to bridge width 206 and/or bridge length 220 of bridged interlocking member 200. In other words, tent support receiver 212 may be configured to orient bridged interlocking member 200 relative to tent support 12 such that tent support 12, or the length thereof, extends at least substantially normal to bridge width 206 and/or bridge length 220.

As perhaps best seen in FIG. 1, tether-receiving portion 204 may include a guy line-receiving region 216 that is configured to receive and couple to a guy line 24 and/or an end thereof. Within tent 40, guy line 24 may be attached to a ground anchor (e.g., a tent stake) that is secured to a support surface, such as a ground surface, and that is utilized to tension tent 40 against the support surface. As such, bridged interlocking member 200 also may be configured to interconnect tent support 12, and thereby tent 40, to a ground anchor. Guy line 24 may include any suitable structure that may be utilized to tension tent 40 against another structure and/or the support surface. Guy line-receiving region 216 may be configured to couple to guy line 24 in a similar manner to tent fabric receiver 108 of pivot interlocking member 100, as discussed herein.

In some examples, tents 40 may include two separate tent fabrics 20, and tent couplers 10 may be configured to selectively couple the two tent fabrics to tent support 12, optionally independently of one another. In such examples, the tent fabric 20 to which pivot interlocking member 100 is connected may be referred to as a first tent fabric 26, and the tent fabric receiver 108 of pivot interlocking member 100 may be referred to as a first tent fabric receiver 108. As shown in FIG. 1, bridged interlocking member 200 may include a second tent fabric receiver 108 that is configured to couple to a second tent fabric 28.

First tent fabric 26 may be one of an inner tent fabric and an outer tent fabric. Second tent fabric 28 may be the other of the inner tent fabric and the outer tent fabric. The outer tent fabric additionally or alternatively may be referred to herein as a fly, a rainfly, and/or a flysheet. Typically, the outer tent fabric extends over the exterior of the assembled tent frame. The inner tent fabric may be hung from the assembled tent frame, positioned within a volume surrounded by the outer tent fabric, and/or positioned at least partially interior to the tent frame.

In some examples, pivot interlocking member 100 is interconnected with the outer tent fabric (i.e., first tent fabric 26 is the outer tent fabric), and bridged interlocking member 200 is interconnected with the inner tent fabric (i.e., second tent fabric 28 is the inner tent fabric). In such examples, second tent fabric receiver 108 may be included in tent support-receiving portion 202 of bridged interlocking member 200. When included, guy line-receiving region 216 may be disposed along tether-receiving portion 204 of bridged interlocking member 200. In some such examples, second tent fabric receiver 108 is positioned farther from bridge 206 than tent support receiver 212. In this way, tension from the inner tent fabric towards the interior of tent 40 may position bridge 206 and tether-receiving portion 204 exterior to tent support 12. As the outer tent fabric may extend over the exterior of the assembled tent frame, in such a configuration outer tent fabric may be attached to tent support 12 simply by moving pivot interlocking member 100 downwardly and interconnecting pivot interlocking member 100 with bridge 206, such as discussed herein. Also in such a configuration, tether-receiving portion 204 may position guy line 24 to extend in a direction exterior to tent 40 such that it may be anchored to the support surface exterior to the outer tent fabric.

Alternatively, pivot interlocking member 100 may be interconnected with the inner tent fabric (i.e., first tent fabric 26 is the inner tent fabric), and bridged interlocking member 200 may be interconnected with the outer tent fabric (i.e., second tent fabric 28 is the outer tent fabric). In such examples, the second tent fabric receiver 108 may be included in tether-receiving portion 204, and guy line-receiving region 216 may be included in tent support-receiving portion 202. In such examples, guy line-receiving region 216 may be positioned farther from bridge 206 than tent support receiver 212, and tension from the outer tent fabric may orient guy line-receiving region 216 to be positioned towards the interior of the tent from tent support 12. In some such examples, bridged interlocking member 200 may be anchored to the support surface by a ground anchor positioned interior to tent support 12.

As perhaps best seen in FIG. 1, bridged interlocking member 200 further may include a third portion 218 and a second bridge 207 that connects third portion 218 to tent support-receiving portion 202. In particular, third portion 218 and tether-receiving portion 204 may be positioned adjacent to opposed sides of tent support-receiving portion 202. Third portion 218 may be dimensioned similarly, or at least substantially similarly, to tether-receiving portion 204. Likewise, the second bridge 207 may include similar, or at least substantially similar, dimensions to those discussed herein for bridge 206. In such examples, tent coupler 10 includes two pivot interlocking members 100, in which a first pivot interlocking member 100 is configured to connect with the outer tent fabric and a second pivot interlocking member 100 is configured to connect to the inner tent fabric. In such examples, bridged interlocking member 200 may not include a tent fabric receiver 108. The first pivot interlocking member 100 may be configured to selectively interlock with bridge 206 to selectively interconnect the outer tent fabric to tent support 12. The second pivot interlocking member 100 may be configured to selectively interlock with second bridge 207 to selectively interconnect the inner tent fabric to tent support 12. Such a configuration may permit the inner and outer tent fabrics to selectively couple to and decouple from tent support 12 independently of one another without removing tent support 12 from tent support receiver 212 of bridged interlocking member 200. With this in mind, when bridged interlocking member 200 further includes second bridge 207 and third portion 218, bridged interlocking member 200 may be fixedly coupled to tent support 12, although this is not required to all tent couplers 10.

Pivot interlocking member 100 also may be configured to couple to tent support 12 independently of bridged interlocking member 200. In other words, pivot interlocking member 100 may be configured to selectively couple to tent support 12 without forming an interlock with bridged interlocking member 200. More specifically, bridge-receiving aperture 102 may be utilized as a tent support receiver. For examples in which tent support 12 is a tent pole, bridge-receiving aperture 102 may be dimensioned and shaped to selectively couple to the recessed end region of the tent pole. For examples in which bridged interlocking member 200 is connected to the inner tent fabric and pivot interlocking member 100 is connected to the outer tent fabric, configuring bridge-receiving aperture 102 in this manner permits tent coupler 10 to selectively interconnect the outer tent fabric to the tent support without the inner tent fabric being coupled thereto via bridged interlocking member 200.

Pivot interlocking member 100 and bridged interlocking member 200 may be configured to selectively interlock with one another and selectively disconnect from one another in any suitable time and/or situation during use of tent 40. As an example, pivot interlocking member 100 and bridged interlocking member 200 may be configured to selectively interlock with one another and selectively disconnect from one another while tent support receiver 212 of the bridged interlocking member 200 is coupled to the tent support 12. As another example, pivot interlocking member 100 and bridged interlocking member 200 may be configured to selectively interlock with one another and selectively disconnect from one another while tent fabric receiver 108 of the pivot interlocking member 100 is interconnected with first tent fabric 26. As yet more examples, pivot interlocking member 100 and bridged interlocking member 200 may be configured to selectively interlock with one another and selectively disconnect from one another while guy line-receiving region 216 of bridged interlocking member 200 is interconnected with guy line 24 and guy line 24 is interconnected with a ground anchor and/or while second tent fabric receiver 108 of bridged interlocking member 200 is interconnected with second tent fabric 28.

Figure 5:
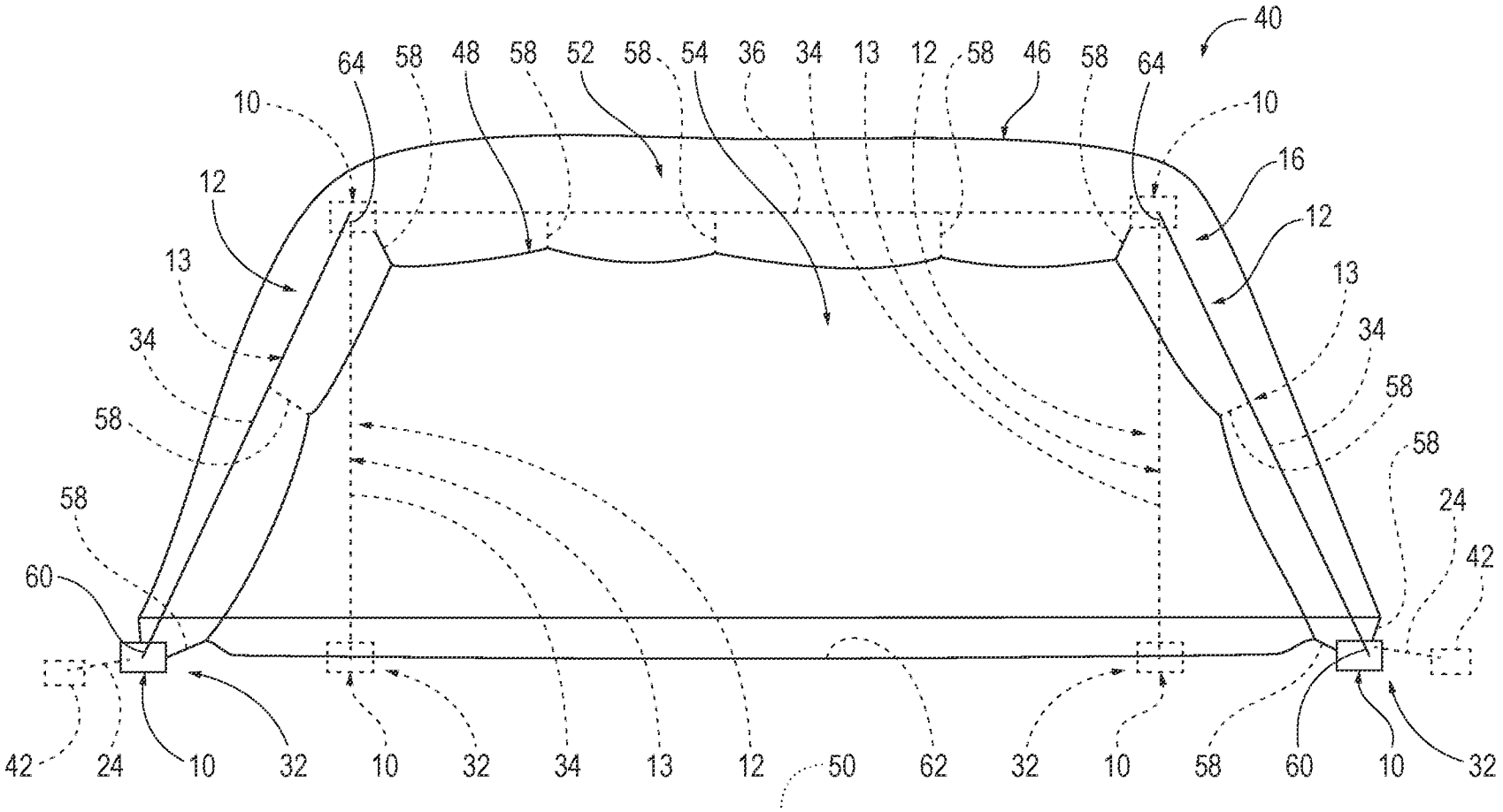
FIG. 5 is a side elevation view schematically illustrating examples of tents that include a plurality of tent couplers according to the present disclosure.

Turning to FIG. 5, illustrated therein is a schematic side elevation view illustrating examples of tents 40 that includes a plurality of tent couplers 10. The tent couplers of FIG. 5 are schematically illustrated and may include any suitable combination of the features, functions, components, etc., of tent couplers 10 discussed herein, including with reference to FIGS. 1-4. As shown in FIG. 5, tent 40 includes a plurality of tent supports 12 that are configured to be assembled to form an assembled tent frame 16. Assembled tent frame 16 is configured to support tent 40 on a support surface 50 and to support an inner tent fabric 48 and/or an outer tent fabric 46 spaced above the support surface 50. Support surface 50 may be, or include, a ground surface.

As discussed, tents 40 may include outer tent fabric 46 and inner tent fabric 48. Outer tent fabric 46 is configured to surround an inner space 52 when coupled to assembled tent frame 16. Inner tent fabric 48 is configured to surround an inner tent space 54 when coupled to assembled tent frame 16. Inner space 52 may surround at least a portion of inner tent space 54.

Tent 40 may be referred to herein as being an assembled tent when tent supports 12 are assembled to form assembled tent frame 16 and either or both of inner tent fabric 48 and outer tent fabric 46 are coupled to assembled tent frame 16 to surround the respective inner spaces. Thus, tents 40 are illustrated in FIG. 5 as assembled tents with both inner tent fabric 48 and outer tent fabric 46 attached to assembled tent frame 16. However, tents 40 also may be assembled with only inner tent fabric 48 or only outer tent fabric 46 attached to assembled tent frame 16.

Tents 40 of FIG. 5 also may be configured to be selectively disassembled from an assembled state to a disassembled state. In the disassembled state, inner tent fabric 48 and outer tent fabric 46 may be decoupled from tent supports 12. This may be achieved at least in part by transitioning tent couplers 10 from interlocked configuration 32 to linking configuration 30, and optionally disconnecting tent couplers 10 from tent supports 12 such as in a manner discussed herein. In the disassembled state, tent supports 12 also may be at least partially disconnected from one another and arranged in a condensed state and/or in a side-by-side relationship. Specifically, tent supports 12 may be or include collapsible tent poles comprising a plurality of segments, and the segments of the collapsible tent poles may be partially disconnected from one another and arranged in a side-by-side relationship in the disassembled state. Tents 40 also may be configured to be selectively assembled from the disassembled state to form assembled tents.

When coupled to assembled tent frame 16, outer tent fabric 46 may extend over, or be supported on, an exterior of assembled tent frame 16. Inner tent fabric 48 may be hung from and/or be at least partially positioned within an interior of assembled tent frame 16. As such, outer tent fabric 46 may at least partially, and optionally at least substantially or even completely, surround inner tent fabric 48.

At least two tent supports 12 of assembled tent frame 16 directly contact support surface 50 and support tent 40 on support surface 50. Tent supports 12 may be, or include, tent poles 13. In particular, assembled tent frame 16 may include a plurality of leg poles 34. Each leg pole 34 extends upwardly from support surface 50 and includes at least one ground-contacting end 60 that contacts support surface 50. Assembled tent frame 16 also may include one or more roof poles 36 which may extend between and interconnect the upper ends of leg poles 34. As referred to herein, an upper end of a leg pole 34 is the end or region of leg pole 34 that is positioned farthest from support surface 50 in assembled tent frame 16.

In FIG. 5, each tent coupler 10 interconnects at least one of, and optionally both, inner tent fabric 48 and outer tent fabric 46 to a tent support 12 of assembled tent frame 16. Thus, each tent coupler 10 coupled to a respective tent support 12 may be in interlocked configuration 32. However, each tent coupler 10 may be configured to selectively interconnect and selectively disconnect inner tent fabric 48 and outer tent fabric 46 to and from the respective tent support 12 independently of one another, such as discussed herein. In other words, tent couplers 10 permit tents 40 to be selectively assembled with only inner tent fabric 48, only outer tent fabric 46, or both outer tent fabric 46 and inner tent fabric 48.

Inner tent fabric 48 and outer tent fabric 46 each may be connected to tent coupler 10 by a tether 58, such as a strap, an adjustable strap, and/or a cord. At least two tent couplers 10 may be connected to, or connected adjacent to, ground-contacting end 60 of the respective tent support 12 that contacts support surface 50. Each of these tent couplers 10 further may be connected to a guy line 24 that may be connected to, or configured to connect to, a ground anchor 42 that secures tent 40 to support surface 50. Tent couplers 10 collectively may tension outer tent fabric 46 across the exterior of assembled tent frame 16 such that outer tent fabric 46 surrounds inner space 52. Similarly, tent couplers 10 collectively may tension at least a floor 62 of inner tent fabric 48 to cover a desired area. Inner tent fabric 48 may be hung by a plurality of tethers 58 that selectively engage with upper or elevated portions of assembled tent frame 16 and that tension inner tent fabric 48 to surround inner tent space 54 together with tent couplers 10.

In some examples, tent couplers 10 are configured to be coupled to, or adjacent to, an upper end 64 of a respective tent support 12, or the end of tent support 12 that is positioned farthest from support surface 50 in assembled tent frame 16. In particular, tent couplers 10 may be coupled to upper ends 64 of tent supports 12 for examples of tents 40 in which inner tent fabric 48 and outer tent fabric 46 are hung from upper ends 64 of tent supports 12 and/or may not be secured adjacent to ground-contacting ends 60 of tent supports 12. Examples of such tents 40 include ultralight tents, fly-style tents, and/or tarp-style tents.

Turning to FIGS. 6-13, additional examples of tent couplers 10 and tents 40 that include tent couplers 10 are illustrated. Where appropriate, the reference numerals from the schematic illustrations of FIGS. 1-5 are used to designate corresponding parts of the examples of FIGS. 6-13. However, the examples of FIGS. 6-13 are non-exclusive and do not limit tent couplers 10 and/or tents 40 to the illustrated embodiments of FIGS. 6-13. That is, tent couplers 10 and/or tents 40 are not limited to the specific embodiments of FIGS. 6-13, and tents 40 may incorporate any number of the various aspects, configurations, characteristics, properties, variants, options etc. of tent couplers 10 and/or tents 40 that are illustrated in and discussed with reference to the schematic representations of FIGS. 1-5 and/or the embodiments of FIGS. 6-13, as well as variations thereof, without requiring the inclusion of all such aspects, configurations, characteristics, properties, etc. Furthermore, any additional aspects, configurations, characteristics, properties, variants, options, etc. disclosed in connection with the tent couplers 10 and/or tents 40 of any of FIGS. 6-13 may be used and/or otherwise included with other tent couplers 10 and/or tents 40 according to the present disclosure, including tent couplers 10 and/or tents 40 according to FIGS. 1-5 or others of FIGS. 6-13. For the purpose of brevity, each previously discussed component, part, portion, aspect, region, etc. or variants thereof may not be discussed, illustrated, and/or labeled again with respect to the examples of FIGS. 6-13; however, it is within the scope of the present disclosure that the previously discussed features, variants, etc. may be utilized with the examples of FIGS. 6-13.

Figure 6:
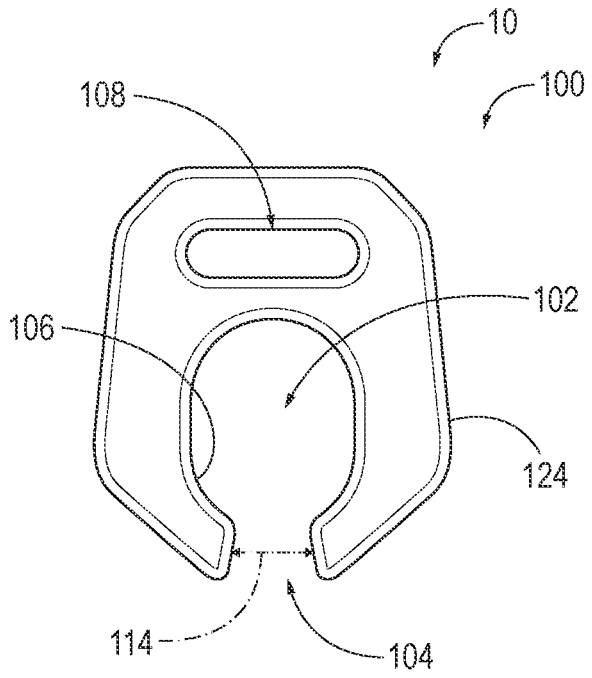
FIG. 6 is a less schematic plan view showing an example of a pivot interlocking member of a tent coupler according to the present disclosure.

FIG. 6 is a less schematic view showing an example of pivot interlocking member 100 according to the present disclosure. As shown, pivot interlocking member 100 includes interior sidewall 106 that defines bridge-receiving aperture 102. Pivot interlocking member 100 defines entrance slot 104 that extends through exterior sidewall 124 and through interior sidewall 106 to provide a passageway through exterior sidewall 124 to bridge-receiving aperture 102. In this example, bridge-receiving aperture 102 comprises a generally cylindrical ovoid shape, with the long axis of the ovoid extending through entrance slot 104. In other words, bridge-receiving aperture 102 is elongated in a direction of entrance slot 104. In this way, interior sidewall 106 may be positioned close to, or even abut, bridge 206 of bridged interlocking member 200 when tent coupler 10 is in interlocked configuration 32. Slot width 114 is narrowed relative to all lateral dimensions of bridge-receiving aperture 102 (i.e., dimensions of bridge-receiving aperture 102 taken along the same plane as slot width 114). In this way, passage of bridge 206 into and out of bridge-receiving aperture 102 is only permitted when pivot interlocking member 100 is oriented in linking orientation 120 relative to bridge 206.

Pivot interlocking member 100 further includes tent fabric receiver 108. In this example, tent fabric receiver 108 includes a slot that is elongated in a direction generally parallel to slot width 114. Tent fabric receiver 108 may be adapted to couple to a tether that selectively connects pivot interlocking member 100 to a tent fabric. Tent fabric receiver 108 is positioned along a region of pivot interlocking member 100 that is distal to, or opposed to, entrance slot 104. This positioning of tent fabric receiver 108 may permit tension from the tent fabric to be utilized to secure tent coupler 10 in interlocked configuration 32.

Figure 7:
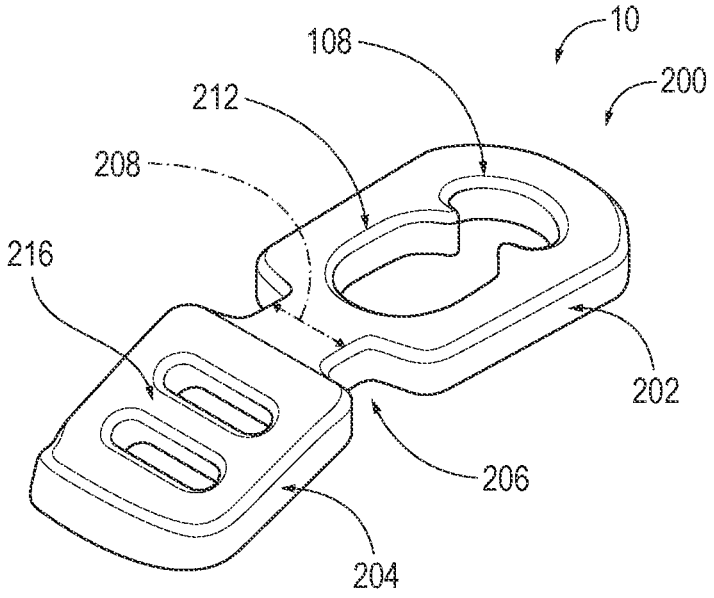
FIG. 7 is a less schematic isometric view showing an example of a bridged interlocking member of a tent coupler according to the present disclosure.

FIG. 7 is a less schematic isometric view showing an example of bridged interlocking member 200 according to the present disclosure. As shown in FIG. 7, bridged interlocking member 200 includes tent support-receiving portion 202, tether-receiving portion 204, and bridge 206 that interconnects tent support-receiving portion 202 and tether-receiving portion 204 with one another. Bridge 206 may be described as being defined by a symmetrical recess formed between tent support-receiving portion 202 and tether-receiving portion 204. Thus, bridge width 208 of bridge 206 is narrower than the width of both tent support-receiving portion 202 and tether-receiving portion 204.

Tether-receiving portion 204 includes guy line-receiving region 216 that is configured to interconnect with a guy line. In some examples, guy line-receiving region 216 is configured to interconnect with a guy line that may be anchored to a support surface, such as discussed herein. In this particular example, guy line-receiving region 216 includes a pair of parallel elongate slots that may be connected to a strap that is, or is utilized as, the guy line. The pair of elongate slots may be utilized as a slip lock and may permit adjustment of the length or extent of the guy line.

Tent support-receiving portion 202 includes tent support receiver 212 and tent fabric receiver 108. Tent support receiver 212 includes a bore that extends through the thickness of tent support-receiving portion 202 and that has a generally cylindrical ovoid shape. Tent support receiver 212 may be dimensioned and shaped to selectively engage a tent support or a tent pole, such as an end region thereof, and/or a recess formed thereon. Tent fabric receiver 108 also includes a bore that extends through the thickness of tent support-receiving portion 202. Tent fabric receiver 108 may be described as having a generally cylindrical ovoid shape with a long axis that is transverse to that of tent support receiver 212. As discussed, tent fabric receiver 108 is configured to selectively engage with a tent fabric, such as via a tether, a strap, an adjustable strap, or the like. Tent fabric receiver 108 is positioned or extends farther from bridge 206 than tent support receiver 212. In this example, tent support receiver 212 and tent fabric receiver 108 are coextensive with one another, which may allow tent support-receiving portion 202 to be formed with a smaller size. However, this is not required for all examples of the present disclosure.

In this example, tent support-receiving portion 202 and bridge 206 generally extend along a common plane. Tether-receiving portion 204 is angled or deflects downwardly from the plane along which tent support-receiving portion 202 and bridge 206 generally extend. Angling tether-receiving portion 204 in this manner may position the distal portion of the lower surface of tether-receiving portion 204 to abut and/or contact the support surface when tent support receiver 212 is coupled to, or adjacent to, the ground-contacting end of a tent support or a tent pole. Contact or abutment of tether-receiving portion 204 with support surface may aid in retaining bridged interlocking member 200 in engagement with the tent support.

In the example of FIG. 7, bridged interlocking member 200 may be configured for attachment of the inner tent fabric to tent fabric receiver 108. In particular, with tent fabric receiver 108 being positioned farther from bridge 206 than tent support receiver 212, tension from the inner tent fabric towards the interior of the tent may orient bridge 206 and guy line-receiving region 216 to extend to the exterior of the tent support received in tent support receiver 212. In this way, bridge 206 may be positioned for facilitate attachment to the outer tent fabric via pivot interlocking member 100 coupled thereto. Also in this orientation, guy line-receiving region 216 may be suitably positioned for attachment to a ground anchor positioned exterior to the tent support.

Figure 8:
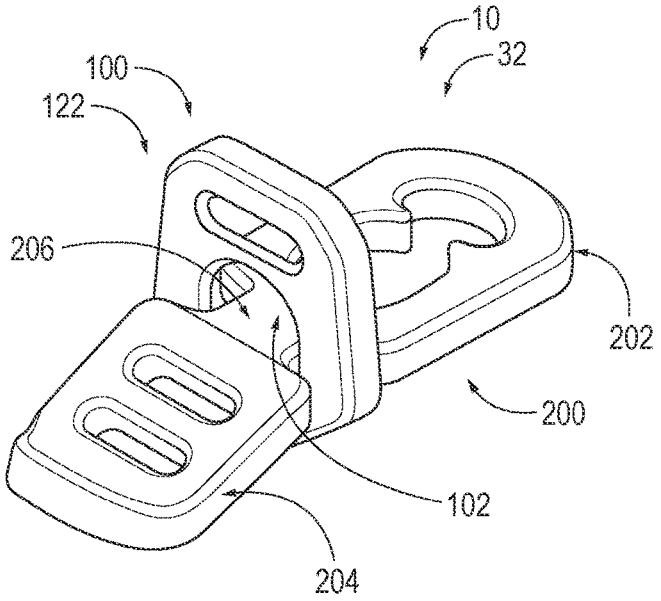
FIG. 8 is a less schematic isometric view of the pivot interlocking member of FIG. 6 and the bridged interlocking member of FIG. 7 in the interlocked configuration.
Figure 9:
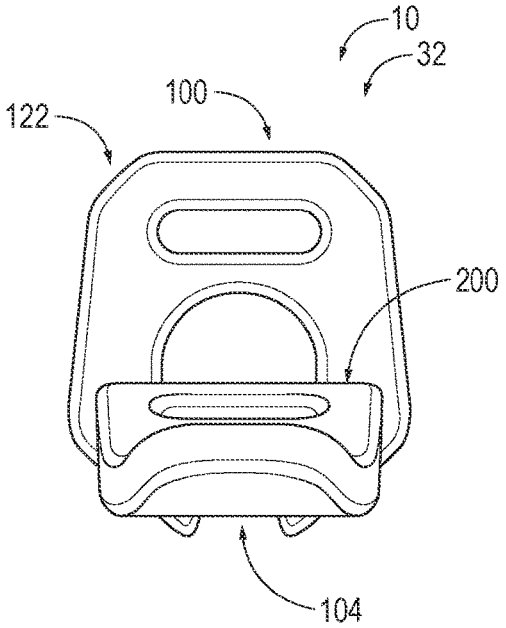
FIG. 9 is an end elevation view of the example of FIG. 8.

FIG. 8 is an isometric view of a tent coupler 10 according to the present disclosure that includes the example pivot interlocking member 100 of FIG. 6 and the example bridged interlocking member 200 of FIG. 7 in interlocked configuration 32. FIG. 9 is another view illustrating the example tent coupler 10 of FIG. 8 in interlocked configuration 32. As shown in FIGS. 8 and 9, bridge 206 of bridged interlocking member 200 is positioned within bridge-receiving aperture 102 of pivot interlocking member 100. Pivot interlocking member 100 is oriented about bridge 206 within the range of interlocked orientations 122. In particular, slot width 114 of entrance slot 104 is aligned with, or parallel to, the bridge width 208 of bridge 206. Tent coupler 10 is dimensioned with bridge width 208 of bridge 206 being greater than slot width 114 of entrance slot 104. Thus, bridge 206 is precluded from being removed from bridge-receiving aperture 102 via entrance slot 104 in interlocked configuration 32. Tent coupler 10 also is dimensioned such that the abutting surfaces formed by tent support-receiving portion 202 and tether-receiving portion 204 may engage the opposed faces of pivot interlocking member 100 to prevent pivot interlocking member 100 from tilting and/or translating off of bridge 206 in interlocked configuration 32. That said, pivot interlocking member 100 may be removed from bridge 206 by pivoting pivot interlocking member 100 in clockwise or counterclockwise directions to the linking orientation.

Figure 10:
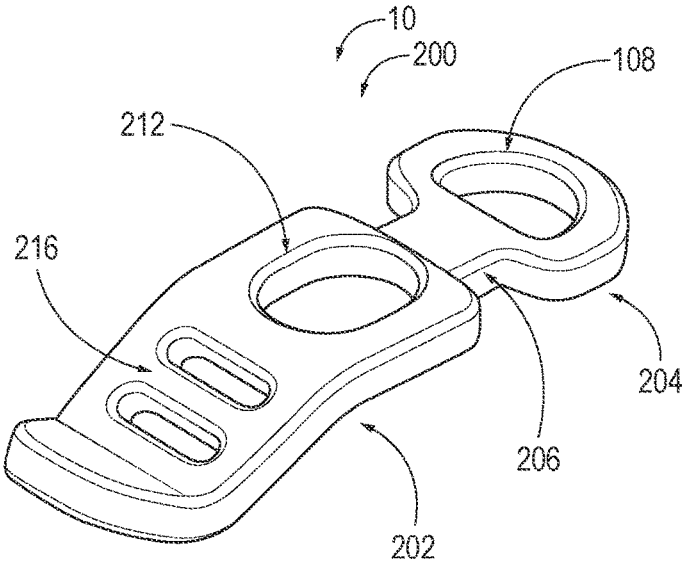
FIG. 10 is an isometric view showing another less schematic example of a bridged interlocking member of a tent coupler according to the present disclosure.

FIG. 10 is a less schematic isometric view illustrating another example of bridged interlocking member 200 according to the present disclosure. In this example, guy line-receiving region 216 is included in tent support-receiving portion 202 along with tent support receiver 212. Tether-receiving portion 204 includes tent fabric receiver 108. Guy line-receiving region 216 is positioned in tent support-receiving portion 202 farther from bridge 206 than tent support receiver 212. In this example, bridged interlocking member 200 may be configured for attachment of tent fabric receiver 108 to the outer tent fabric. In such an example, and when installed in an assembled tent, tension from the outer tent fabric may orient guy line-receiving region 216 to be positioned towards the interior of the tent from the tent support to which tent support receiver 212 is coupled. In this configuration, guy line-receiving region 216 may be attached via a guy line that is anchored to the support surface inside of the outer tent fabric. Such a configuration may be utilized for a dry set up, in which the outer tent fabric is attached to the assembled tent frame before the inner tent fabric.

Figure 11:
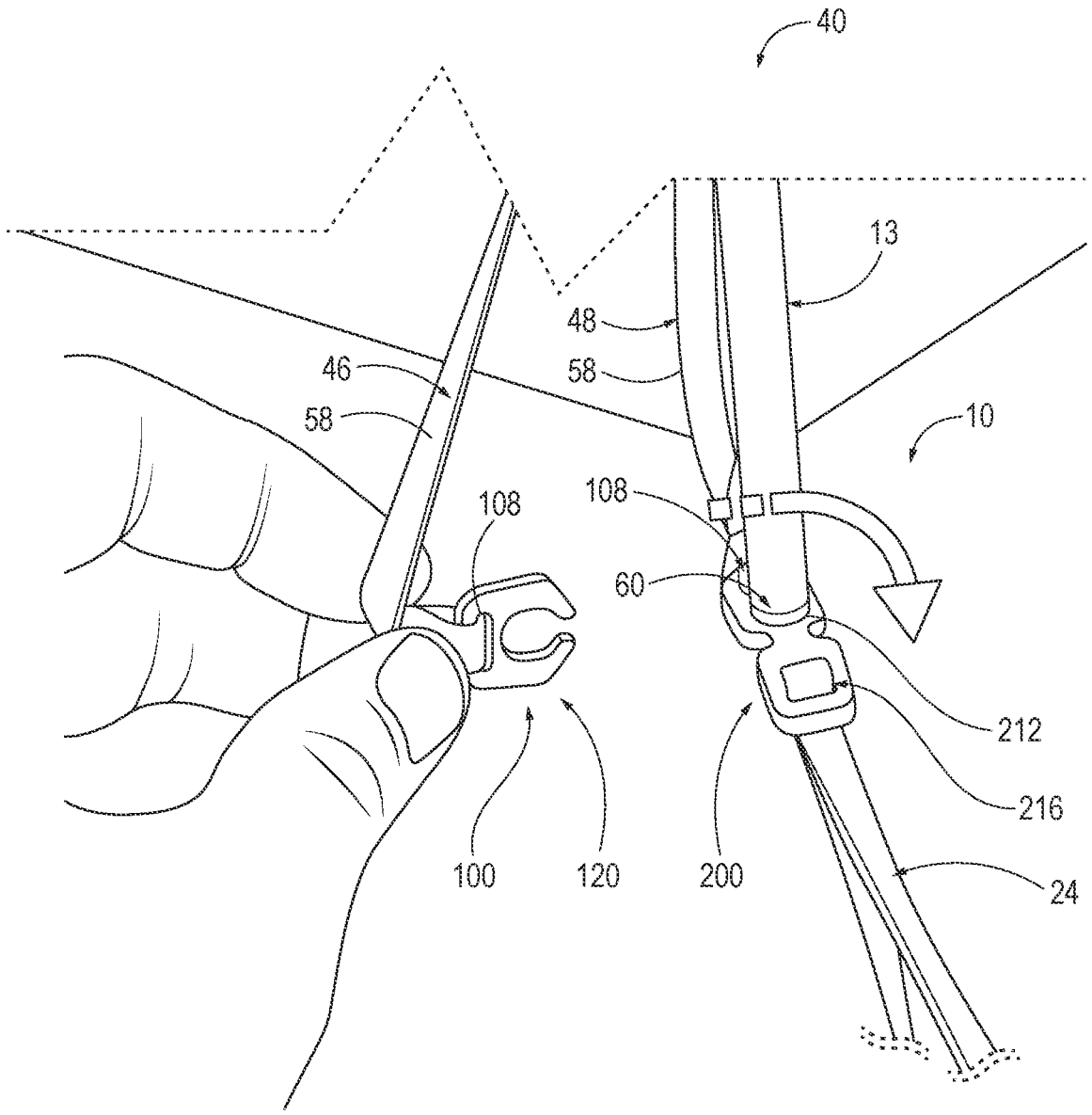
FIG. 11 is a less schematic fragmentary view of a tent showing a user interconnecting an outer tent fabric of the tent to a tent support of the tent with the example tent coupler of FIG. 8.

Turning to FIG. 11, illustrated therein is a partial view of tent 40 that includes the example tent coupler 10 of FIGS. 8-9. In particular, FIG. 11 illustrates an example of a user coupling outer tent fabric 46 to tent pole 13 of tent 40 utilizing tent coupler 10. As shown in FIG. 11, tent support receiver 212 of bridged interlocking member 200 receives and is engaged with a region of tent pole 13 adjacent to its ground-contacting end 60. Tent support receiver 212 orients bridged interlocking member 200 relative to tent pole 13 such that bridge 206 extends at least substantially normal to tent pole 13, or the length thereof. Tent fabric receiver 108 of bridged interlocking member 200 is connected to inner tent fabric 48 via tether 58, and tension from inner tent fabric 48 orients bridge 206 and tether-receiving portion 204 of bridged interlocking member 200 to extend exterior to tent pole 13. In other words, bridged interlocking member 200 interconnects inner tent fabric 48 to tent pole 13 adjacent to ground-contacting end 60 thereof. Guy line-receiving region 216 is interconnected with a strap that may be utilized as guy line 24 to attach bridged interlocking member 200 to a ground anchor positioned exterior to tent pole 13.

Tent fabric receiver 108 of pivot interlocking member 100 is interconnected with outer tent fabric 46 via tether 58. To couple outer tent fabric 46 to tent pole 13, the user orients pivot interlocking member 100 in linking orientation 120. With pivot interlocking member 100 in linking orientation 120, the user moves the bridge-receiving aperture 102 of pivot interlocking member 100 onto bridge 206 and pivots pivot interlocking member 100 from linking orientation 120 in the direction indicated by the partially-dashed arrow to transition tent coupler 10 to the interlocked configuration. As such, tent coupler 10 may allow the user to couple outer tent fabric 46 to tent pole 13 in a one-handed operation or without using both of the user's hands.

Figure 12:
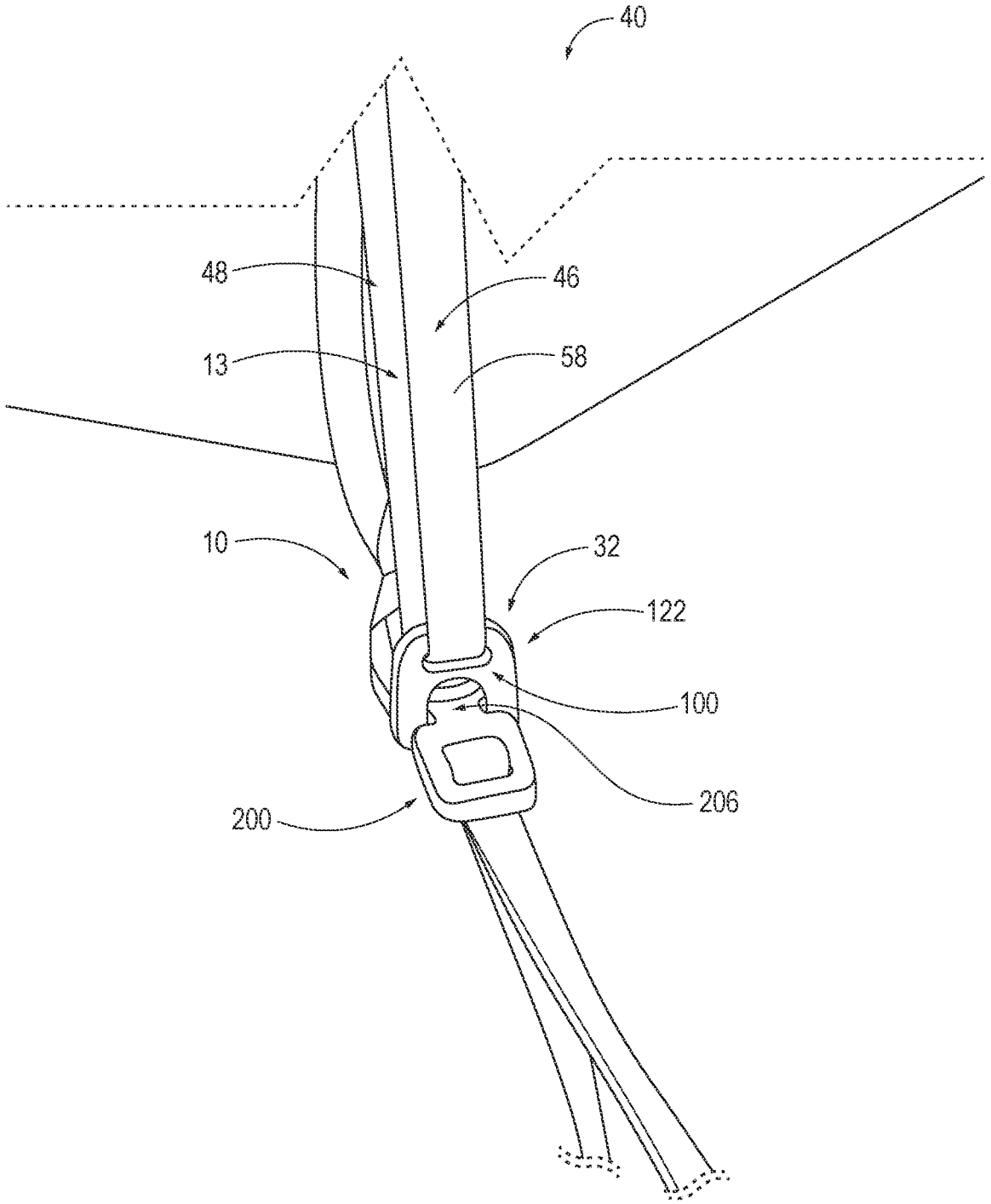
FIG. 12 is a less schematic fragmentary view of the tent of FIG. 11 showing the example tent coupler of FIG. 8 connecting the outer tent fabric to the tent support.

FIG. 12 shows the example tent 40 and tent coupler 10 of FIG. 11 with tent coupler 10 now in interlocked configuration 32. In interlocked configuration, tent coupler 10 interconnects inner tent fabric 48 and outer tent fabric 46 to tent pole 13. Pivot interlocking member 100 is pivoted from the orientation shown in FIG. 11 to within the range of interlocking orientations 122. Upward tension on pivot interlocking member 100 by outer tent fabric 46 via tether 58 biases pivot interlocking member 100 within the range of interlocked orientations 122 and tent coupler 10 in interlocked configuration 32. To selectively decouple outer tent fabric 46 from tent pole 13, a user may simply pivot or turn pivot interlocking member 100 from the interlocked orientation shown in FIG. 12 to the linking orientation and move pivot interlocking member 100 from engagement with bridge 206. Inner tent fabric 48 also may be selectively decoupled from tent pole 13 by selectively decoupling bridged interlocking member 200 from tent pole 13.

Figure 13:
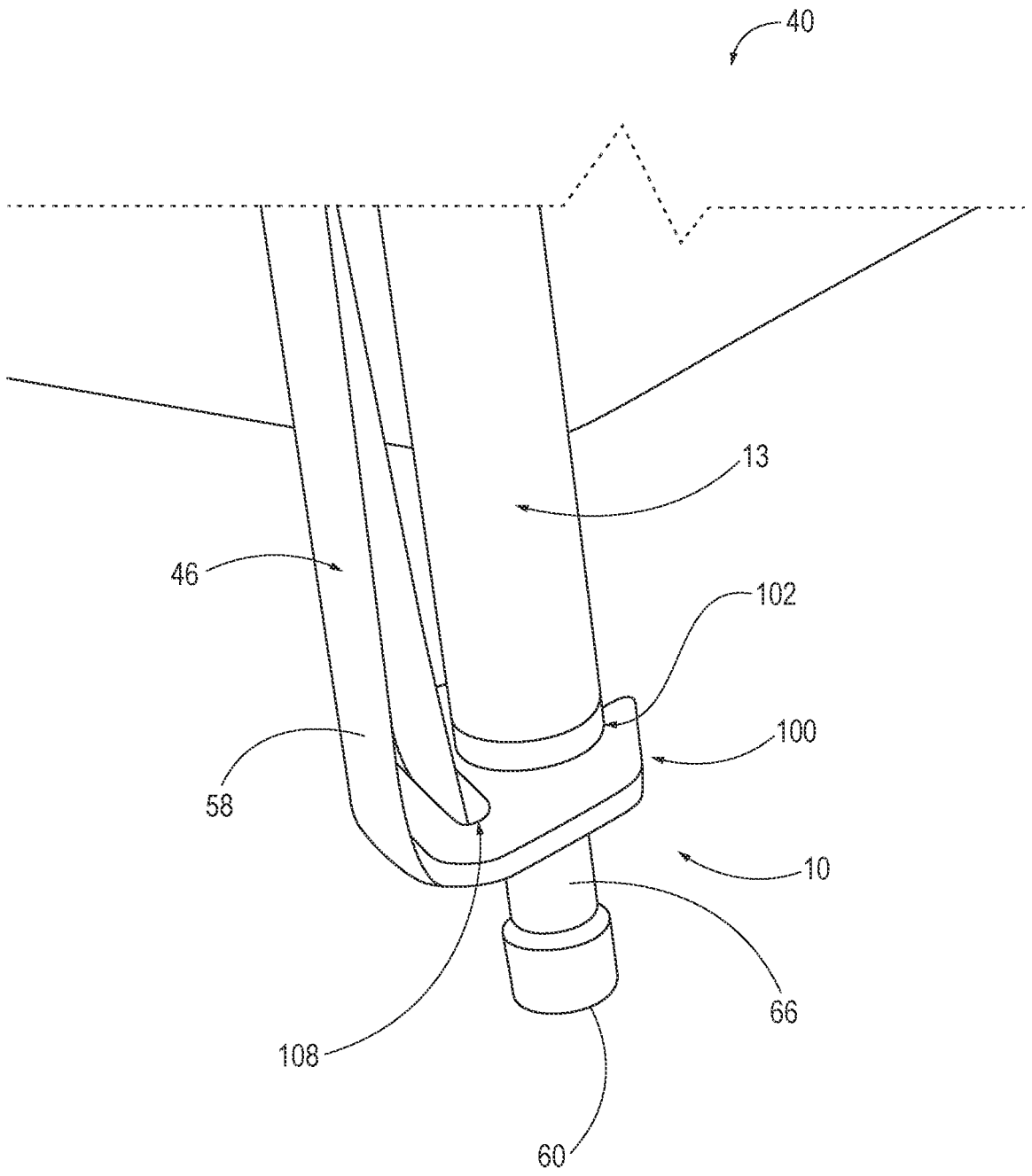
FIG. 13 is a less schematic fragmentary view of a tent showing the pivot interlocking member of a tent coupler directly coupled to a tent support and an outer tent fabric.

FIG. 13 is another partial view of tent 40 that includes tent coupler 10 showing pivot interlocking member 100 of tent coupler 10 coupled to tent pole 13. In particular, tent pole 13 includes a recess 66, which may be a cylindrical recess, adjacent to ground-contacting end 60. Tent fabric receiver 108 of pivot interlocking member 100 is coupled to outer tent fabric 46 via tether 58. Bridge-receiving aperture 102 is received on recess 66 such that pivot interlocking member 100 couples outer tent fabric 46 to tent pole 13. Upward tension from outer tent fabric 46 may assist in retaining pivot interlocking member 100 in engagement with recess 66. Thus, in this example, pivot interlocking member 100 couples outer tent fabric 46 directly to tent pole 13 without engaging bridged interlocking member 200. Such a configuration may be utilized during a dry set up in which outer tent fabric 46 is attached to tent poles 13 prior to inner tent fabric 48. Such a configuration also may be utilized for a fly-only set up in which tent 40 is assembled with outer tent fabric 46 alone.

Figure 14:
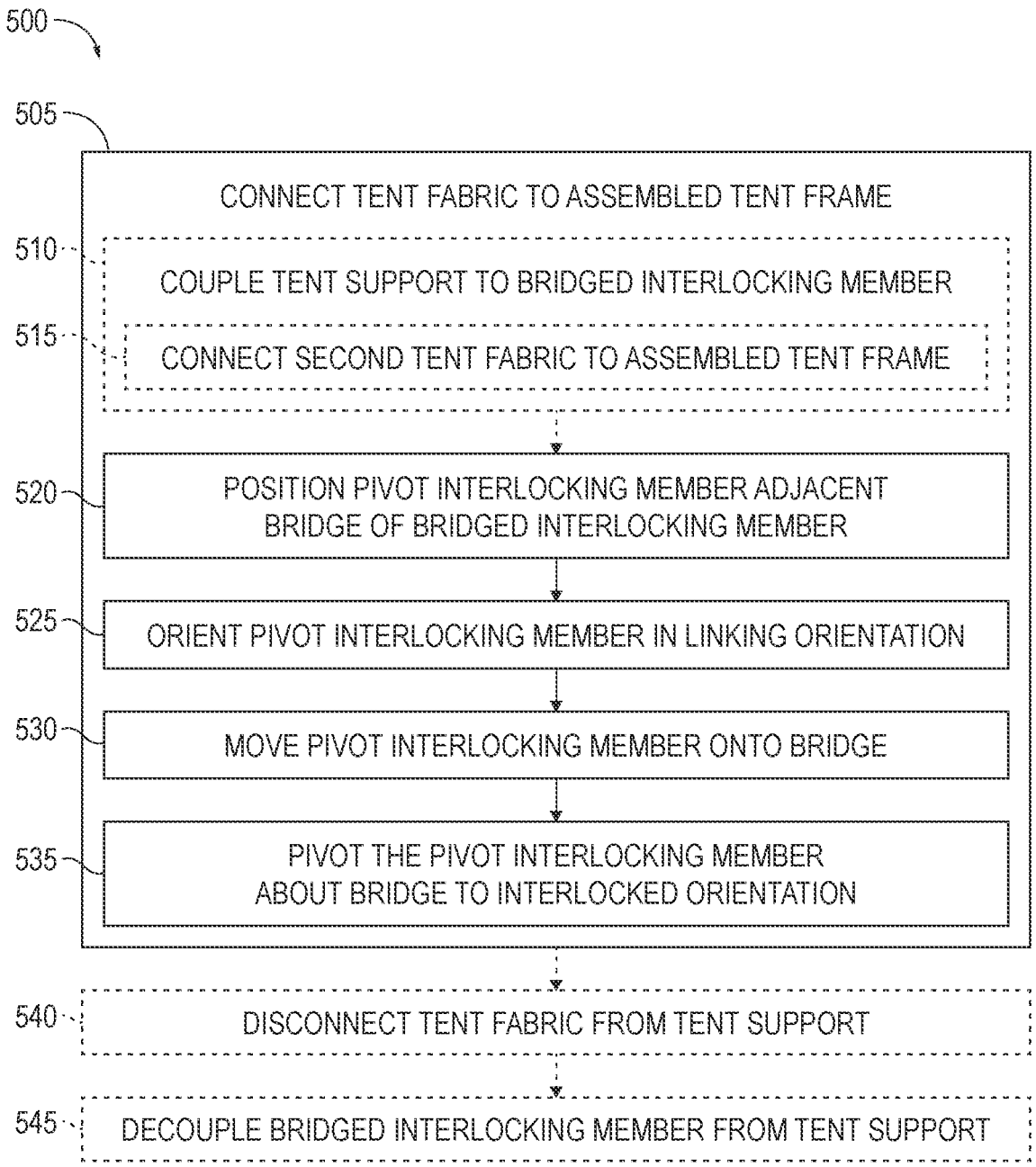
FIG. 14 is a flowchart schematically representing examples of methods according to the present disclosure.

FIG. 14 is a flowchart schematically representing examples of methods 500 according to the present disclosure. In FIG. 14, some steps are illustrated in dashed boxes, indicating that such steps are optional or correspond to an optional version of methods 500 according to the present disclosure. That said, not all methods 500 according to the present disclosure are required to comprise each of the steps illustrated in solid boxes. The methods and steps illustrated in FIG. 10 are non-limiting, and other methods and steps are within the scope of the present disclosure, including methods having greater than or fewer than the number of steps illustrated, as understood from the discussion herein.

Methods 500 relate to utilizing one or more tent couplers to selectively couple one or more tent fabrics to one or more tent supports. Methods 500 may include or be performed as a portion of assembling and/or disassembling tents 40. Methods 500 may include utilizing tent couplers 10 and/or tents 40 that are illustrated and discussed herein with reference to FIGS. 1-13. That is, tent couplers 10 and/or tents 40 that are illustrated and discussed herein with reference to FIGS. 1-13 may include any of the features, functions, properties, components, etc., as well as variants thereof, as those discussed herein with reference to methods 500 and FIG. 14 without requiring inclusion of all such features, functions, components, etc. Likewise, tent couplers 10 and/or tents 40 discussed herein in connection to methods 500 and FIG. 14 may incorporate any of the features, functions, properties, components, etc., as well as variants thereof, as those discussed herein with reference to FIGS. 1-13 without requiring inclusion of all such features, functions, components, etc.

As shown in FIG. 14, methods 500 include connecting 505 a tent fabric to a tent support of a tent frame utilizing a tent coupler that includes a bridged interlocking member and a pivot interlocking member. The connecting 505 includes positioning 520 the pivot interlocking member adjacent to a bridge of a bridged interlocking member, orienting 525 the pivot interlocking member in a linking orientation relative to the bridge, moving 530 the pivot interlocking member to translate the bridge into a bridge-receiving aperture of the pivot interlocking member, and pivoting 535 the pivot interlocking member about the bridge from the linking orientation to within a range of interlocked orientations. The connecting 505 may include coupling 510 the tent support to a tent support receiver of the bridged interlocking member, which may include connecting 515 a second tent fabric to the tent support. Methods 500 may include disconnecting 540 the tent fabric from the tent support and/or decoupling 545 the tent support from the tent fabric receiver of the bridge interlocking member.

The connecting 505 may include connecting the tent fabric 20 to the tent support 12 of an assembled tent frame 16. For example, the tent frame may be assembled prior to the connecting 505 or methods 500 may include assembling the tent frame to form the assembled tent frame 16 prior to the connecting 505. As an example, the assembled tent frame 16 may be a free-standing tent frame in which the plurality of tent supports of the tent frame interconnect with one another to form a self-supporting structure that extends above the support surface 50 without attachment to and/or tension from the tent fabric 20. Additionally or alternatively, the connecting 505 may be performed, at least in part, to assemble the tent frame as the assembled tent frame 16, such as by applying tension to ends of the tent frame with the tent fabric 20 to raise a central region of the tent frame above the support surface 50.

Methods 500 may include performing the connecting 505 a plurality of times to connect the tent fabric 20 to a plurality of the tent supports 12 utilizing a plurality of tent couplers 10. As a more specific example, the tent frame may include a plurality of leg poles 34, and methods 500 may include repeating the connecting 505 a plurality of times to connect the tent fabric 20 to each leg pole 34. Each connecting 505 may include utilizing a different tent coupler 10 to couple the tent fabric 20 to a respective tent support 12 and optionally to a respective leg pole 34.

As shown in FIG. 14, the connecting 505 may include coupling 510 the tent support to a tent support receiver of the bridged interlocking member. As discussed herein, the bridged interlocking member 200 may be configured to selectively couple to the tent support 12 via the tent support receiver 212. In some examples, the coupling 510 comprises orienting the bridge 206 of the bridge interlocking member to extend transverse to, and optionally normal to, the tent support 12, or to the length of the tent support 12. Alternatively, in some examples, the bridged interlocking member 200 may be fixedly coupled to the tent support 12. In some such examples, the bridge interlocking member 200 may include a second bridge 206, as discussed herein. For examples in which the bridge interlocking member 200 is fixedly coupled to the tent support 12, the connecting 505 may not include the coupling 510. For examples in which the connecting 505 includes the coupling 510, the coupling 510 may be performed prior to the positioning 520, the orienting 525, and the pivoting 535.

As discussed herein, the bridged interlocking member 200 may be interconnected with a second tent fabric 28, which may be an inner tent fabric 48. In such examples, the coupling 510 may include connecting 515 the second tent fabric 28, which optionally is an inner tent fabric 48, to the tent support 12. Accordingly, the connecting 505 may include connecting a first tent fabric 26 and a second tent fabric 28 to the tent support 12. The second tent fabric 28 may be interconnected with a plurality of bridged interlocking members 200, and the coupling 510 may include coupling the plurality of bridged interlocking members 200 to a respective plurality of tent supports 12, as discussed herein. In some examples, the connecting 505 includes coupling 510 the bridged interlocking members 200 to the respective tent supports 12 prior to the positioning 520, the orienting 525, and the pivoting 535. In some such examples, the connecting 515 the second tent fabric 28, such as the inner tent fabric 48, is performed as a portion of assembling the tent frame as the assembled tent frame 16 and/or to raise a central region of the tent frame above the support surface 50. In some examples, the connecting 515 the second tent fabric 28 to the tent frame further includes interconnecting and/or hanging portions of the second tent fabric 28 from the central region of the assembled tent frame 16 that is raised above the support surface 50 such that the second tent fabric 28 surrounds an inner space 52 or an inner tent space 54.

For examples in which the bridged interlocking member 200 is fixedly coupled to the tent support 12, or methods 500 do not include the coupling 510, the connecting 515 the second tent fabric to the tent support 12 may include interlocking a pivot interlocking member 100 that is interconnected with the second tent fabric 28 with the second bridge 206 of the bridged interlocking member 200. The interlocking may include may include positioning 520, orienting 525, moving 530, and pivoting 535 this pivot interlocking member 100 relative to the second bridge 206 to interlock this pivot interlocking member 100 with the second bridge 206 of the bridge interlocking member in a similar, or at least substantially similar, manner to that discussed herein with reference to the tent fabric 20.

With continued reference to FIG. 14, the connecting 505 includes positioning 520 a pivot interlocking member 100 that is interconnected with the tent fabric adjacent to the bridge of the bridged interlocking member that is coupled to the tent support. As discussed herein, the tent fabric 20 may be a first tent fabric 26 and optionally an outer tent fabric 46. The connecting 505 also includes orienting 525 the pivot interlocking member in a linking orientation relative to the bridge of the bridge interlocking member, as discussed herein. For example, the orienting 525 may include at least substantially aligning a linking axis 130 of the pivot interlocking member 100 with a bridge width 208 of the bridge and/or at least substantially aligning a slot width 114 of the pivot interlocking member 100 with a bridge length 220 of the bridge 206, as discussed herein. The orienting 525 may be performed at least substantially simultaneously with or subsequent to the positioning 520.

The connecting 505 further includes moving 530 the pivot interlocking member in the linking orientation relative to the bridge of the bridged interlocking member to translate the bridge through an entrance slot of the pivot interlocking member and into a bridge-receiving aperture of the pivot interlocking member. The moving 530 may be performed subsequent to the positioning 520 and subsequent to the orienting 525. Subsequent to the moving 530, the connecting 505 includes pivoting 535 the pivot interlocking member, while the bridge is positioned in the bridge-receiving aperture, from the linking orientation to within a range of interlocked orientations. As discussed herein, when the bridge 206 of the bridged interlocking member 200 is received in the bridge-receiving aperture 102 and the pivot interlocking member 100 is oriented in the range of interlocking orientations, removal of the bridge 206 from the bridge-receiving aperture 102 is restricted. Thus, the tent coupler 10 is in the interlocked configuration discussed herein subsequent to the pivoting 535, and the tent coupler 10 couples the tent fabric 20 to the tent support 12 subsequent to the pivoting 535. Accordingly, the pivoting 535 additionally or alternatively may be referred to as interlocking the pivot interlocking member 100 and the bridge interlocking member 200.

The pivoting 535 may include pivoting the pivot interlocking member in a clockwise direction or in a counterclockwise direction, as discussed herein. The pivoting 535 also may include pivoting the pivot interlocking member 100 to any suitable interlocked orientation and/or through any suitable angle to among the range of interlocked orientations, more specific examples of which are discussed herein. The pivoting 535 also may include pivoting the pivot interlocking member 200 to a principle interlocked orientation, as discussed herein.

As discussed, the tent 40 may include a plurality of tent supports and a corresponding plurality of tent couplers 10 to connect the tent fabric(s) to the tent supports. In such examples, methods 500 may include repeating the connecting 505 a plurality of times with the plurality of tent couplers 10 to selectively couple the tent fabric(s) to the plurality of tent supports 12. In such examples, the connecting 505 may include repeating the positioning 520, the orienting 525, the moving 530, and the pivoting 535 respective to each tent coupler 10, as discussed herein. More specifically, as discussed herein, the tent fabric 20, and optionally the outer tent fabric 46, may be interconnected with a plurality of the pivot interlocking members 100. A respective plurality of bridged interlocking members 200 may be coupled to a respective plurality of tent supports 12, or the connecting 505 may include coupling 510 the plurality of bridged interlocking members 200 to the respective plurality of tent supports 12, and the connecting 505 further may include performing the positioning 520, the orienting 525, the moving 530, and the pivoting 535 respective to each pivot interlocking member 100 and the corresponding bridged interlocking member 200.

As mentioned, in some examples, the tent supports 12 do not form the assembled tent frame 16 without attachment to the inner tent fabric and/or the outer tent fabric. With this in mind, in some examples, the connecting 505 and the repeating the connecting 505 include, or are performed as a portion of, assembling the plurality of tent supports 12 to form the assembled tent frame. Also with this in mind, the connecting 505 and the repeating the connecting 505 may include, or be performed as a portion of, assembling the tent to form an assembled tent.

With continued reference to FIG. 14, methods 500 may include disconnecting 540 the tent fabric from the tent support. When included in methods 500, the disconnecting 540 includes pivoting the pivot interlocking member from within the range of interlocked orientations to the linking orientation, and moving the pivot interlocking member relative to the bridge of the bridge interlocking member to translate the bridge out of the bridge-receiving aperture through the entrance slot of the pivot interlocking member. Thus, subsequent to the disconnecting, the pivot interlocking member 100 is detached from the bridged interlocking member 200 and the tent fabric 20 is disconnected from the tent support. For examples in which methods 500 include repeating the connecting 505, methods 500 also may include repeating the disconnecting 540 to disconnect the tent fabric 20 from the plurality of tent supports 12.

The disconnecting 540 may be performed subsequent to the connecting 505, subsequent to the repeating the connecting 505, and/or with the tent coupler 10 initially in the interlocked configuration, as discussed herein. To disconnect the tent fabric 20 from the assembled tent frame 16, methods 500 may include repeating the disconnecting 540 respective to each tent coupler 10 comprised in the tent 40.

The disconnecting 540 may be performed as a portion of selectively disassembling the assembled tent. Additionally or alternatively, the disconnecting 540 may be performed to change a configuration of the assembled tent. For example, when the pivot interlocking member is connected to the outer tent fabric 46, the disconnecting 540 may be performed to selectively disconnect the outer tent fabric 46 from the assembled tent frame 16 without disconnecting the inner tent fabric 48 from the assembled tent frame 16. Thus, the disconnecting 540 may not include decoupling the bridged interlocking member 200 from the tent support 12.

With continued reference to FIG. 14, methods 500 further may include decoupling 545 the bridged interlocking member from the tent support, which may include removing the tent support from the tent support receiver of the bridged interlocking member. As mentioned, the bridged interlocking member 200 may be interconnected with the second tent fabric 28 or the inner tent fabric 48. In such examples, the decoupling 545 includes disconnecting the second tent fabric 28 or the inner tent fabric 48 from the tent support 12. The decoupling 545 may be performed for examples in which the connecting 505 includes the coupling 510. For examples in which the methods 500 include repeating the coupling 510 a plurality of times, the methods further may include repeating the decoupling 545 a corresponding plurality of times to detach each bridged interlocking member 200 from each respective tent support 12 and/or to detach the second tent fabric 28 or the inner tent fabric 48 from the plurality of tent supports 12. Accordingly, the decoupling 545 may be performed as a portion of disassembling the tent 40.

Examples of tent couplers 10, tents 40, and methods 500 according to the present disclosure are presented in the following enumerated paragraphs:

A. A tent coupler configured to selectively interconnect a tent fabric and a tent support of a tent to one another, the tent coupler comprising:

a bridged interlocking member comprising:

a tent support-receiving portion comprising a tent support receiver configured to selectively couple to the tent support, a tether-receiving portion, and a bridge that extends between and supports the tent support-receiving portion and the tether-receiving portion spaced apart from one another, wherein the bridge defines a bridge width that is less than a width of each of the tent support-receiving portion and the tether-receiving portion;

a pivot interlocking member comprising a tent fabric receiver configured to interconnect with the tent fabric, wherein the pivot interlocking member defines:

a bridge-receiving aperture extending through a thickness of the pivot interlocking member and configured to selectively receive the bridge of the bridged interlocking member;

an entrance slot interconnected with the bridge-receiving aperture and configured to permit selective movement of the bridge into and out of the bridge-receiving aperture;

wherein the tent coupler is configured to selectively transition between a linking configuration and an interlocked configuration, wherein in the linking configuration, the pivot interlocking member is positioned and orientated relative to the bridged interlocking member for translation of the bridge into and from the bridge-receiving aperture via the entrance slot, and wherein in the interlocked configuration, the bridge is positioned within the bridge-receiving aperture and the pivot interlocking member is oriented within a range of interlocked orientations about the bridge that restrict removal of the bridge from the bridge-receiving aperture through the entrance slot.

A1. The tent coupler of paragraph A, wherein in the linking configuration, the pivot interlocking member is oriented in a linking orientation relative to the bridge.

A2. The tent coupler of paragraph A1, wherein the linking orientation is outside of the range of interlocked orientations.

A3. The tent coupler of paragraph A1, wherein the bridge of the bridged interlocking member defines a central axis that extends through the bridge perpendicular to the bridge width, and wherein the pivot interlocking member is configured to pivot about the central axis to transition among the linking orientation and the range of interlocked orientations.

A4. The tent coupler of any of paragraphs A1-A3, wherein the pivot interlocking member defines a linking axis that extends through a aperture axis of the bridge-receiving aperture and centrally through the entrance slot, wherein when the pivot interlocking member is in the linking orientation about the bridge, the linking axis of the pivot interlocking member is at least substantially parallel to the bridge width of the bridge, and wherein when the pivot interlocking member is within the range of interlocked orientations about the bridge, the linking axis of the pivot interlocking member is between oblique to and perpendicular to the bridge width of the bridge.

A5. The tent coupler of paragraph A4, wherein the entrance slot defines a slot width and wherein the linking axis extends perpendicular to the slot width.

A6. The tent coupler of any of paragraphs A4-A5, wherein the range of interlocked orientations comprises a principle interlocked orientation in which the linking axis is at least substantially perpendicular to the bridge width.

A7. The tent coupler of any of paragraphs A1-A6, wherein the linking orientation is a first linking orientation of two linking orientations that further comprises a second linking orientation, and wherein the pivot interlocking member is pivoted 180 degrees about a/the central axis of the bridge from the first linking orientation to the second linking orientation.

A8. The tent coupler of any of paragraphs A-A7, wherein the pivot interlocking member comprises an interior sidewall that defines the bridge-receiving aperture and an exterior sidewall that defines an exterior of the pivot interlocking member.

A9. The tent coupler of paragraph A8, wherein the entrance slot extends through the exterior sidewall and through the interior sidewall to define a passage from the bridge-receiving aperture through the exterior of the pivot interlocking member.

A10. The tent coupler of any of paragraphs A8-A9, wherein in the interlocked configuration, the interior sidewall of the pivot interlocking member engages the bridge of the bridged interlocking member to restrict the bridge from being removed from the bridge-receiving aperture via the entrance slot.

A11. The tent coupler of any of paragraphs A-A10, wherein the bridge-receiving aperture of the pivot interlocking member defines at least one aperture diameter that is measured through a/the aperture axis of the bridge-receiving aperture and between opposing portions of a/the interior sidewall of the pivot interlocking member, and wherein the at least one aperture diameter of the bridge-receiving aperture is greater than the bridge width of the bridge of the bridged interlocking member.

A12. The tent coupler of paragraph A11, wherein the at least one aperture diameter of the bridge-receiving aperture is greater than a/the slot width of the entrance slot.

A13. The tent coupler of any of paragraphs A11-A12, wherein the at least one aperture diameter of the bridge-receiving aperture is less than the width of each of the tent support-receiving portion and the tether-receiving portion of the bridged interlocking member.

A14. The tent coupler of any of paragraphs A-A13, wherein the pivot interlocking member comprises a pair of opposed faces, and wherein a/the interior sidewall and the exterior sidewall of the pivot interlocking member extend between the pair of opposed faces.

A15. The tent coupler of paragraph A14, wherein the thickness of the pivot interlocking member is measured between the pair of opposed faces, wherein the bridge of the bridged interlocking member includes a bridge length that is measured between the tent support-receiving portion and the tether-receiving portion of the bridged interlocking member, and wherein the bridge length is greater than the thickness of the pivot interlocking member.

A16. The tent coupler of any of paragraphs A14-A15, wherein the tent support-receiving portion and the tether-receiving portion of the bridged interlocking member form abutting surfaces positioned on either side of the bridge and extend outwardly beyond the bridge width, and wherein when bridge is positioned within the bridge-receiving aperture and the pivot interlocking member is oriented within the range of interlocked orientations about the bridge, the abutting surfaces are configured to engage the pair of opposed faces of the pivot interlocking member to prevent the pivot interlocking member from tilting about the bridge and/or translating off of the bridge.

A17. The tent coupler of any of paragraphs A-A16, wherein the bridge of the bridged interlocking member includes a bridge thickness that is measured perpendicular to the bridge width and perpendicular to a/the bridge length, and wherein the bridge thickness is less than a/the slot width of the entrance slot of the pivot interlocking member, and optionally wherein the bridge width of the bridge is greater than the slot width.

A18. The tent coupler of paragraph A17, wherein a ratio of the slot width to the bridge thickness at least partially determines the range of the interlocked orientations, and wherein the range of interlocked orientations decreases with an increase in the ratio of the slot width to the bridge thickness.

A19. The tent coupler of any of paragraphs A17-A18, wherein the bridge width of the bridge is greater than the bridge thickness of the bridge.

A20. The tent coupler of any of paragraphs A-A19, wherein the tent coupler is configured to interconnect the tent fabric to the tent support when:

(i) the tent coupler is in the interlocked configuration;

(ii) the pivot interlocking member is coupled to the tent fabric;

(iii) the bridged interlocking member is coupled to the tent support; and wherein the tent coupler is configured to selectively disconnect the tent fabric from the tent support when the tent coupler is in the linking configuration and the pivot interlocking member is disconnected from the bridged interlocking member.

A21. The tent coupler of any of paragraphs A-A20, wherein the bridged interlocking member further comprises a guy line-receiving region configured to couple to a guy line, and wherein the guy line is configured to interconnect the bridged interlocking member to a ground anchor that is configured to anchor the tent to a support surface.

A22. The tent coupler of any of paragraphs A-A21, wherein the tent fabric is a first tent fabric, wherein the tent further comprises a second tent fabric, and wherein the tent coupler is configured to selectively interconnect the first tent fabric and the second tent fabric to the tent support, optionally independently of one another.

A23. The tent coupler of any of paragraphs A-A22, wherein the tent coupler comprises a plurality of tent fabric receivers, wherein the tent fabric receiver is a first tent fabric receiver of the plurality of tent fabric receivers, and wherein the bridged interlocking member further comprises a second tent fabric receiver of the plurality of tent fabric receivers, and wherein the second tent fabric receiver is configured to couple to the second tent fabric.

A24. The tent coupler of paragraph A23, wherein the first tent fabric is an outer tent fabric and the second tent fabric is an inner tent fabric, and wherein the second tent fabric receiver is included in the tent support-receiving portion of the bridged interlocking member.

A25. The tent coupler of paragraph A24, wherein a/the guy line-receiving region is disposed along the tether-receiving portion of the bridged interlocking member.

A26. The tent coupler of paragraph A23, wherein the first tent fabric is an inner tent fabric, wherein the second tent fabric is an outer tent fabric, and wherein the second tent fabric receiver is included the tether-receiving portion of the bridged interlocking member, and wherein a/the guy line-receiving region is included in the tent support-receiving portion of the bridged interlocking member.

A27. The tent coupler of any of paragraphs A-A26, wherein the bridge of the bridged interlocking member is a first bridge, wherein the bridged interlocking member further comprises a third portion and a second bridge that interconnects the third portion to the tent support-receiving portion, wherein the pivot interlocking member is a first pivot interlocking member of a plurality of pivot interlocking members included in the tent coupler, wherein the plurality of pivot interlocking members further include a second pivot interlocking member, wherein the first pivot interlocking member is configured to selectively interlock with the first bridge to selectively interconnect a/the outer tent fabric to the tent support and the second interlocking is configured to selectively interlock with the second bridge to selectively interconnect a/the inner tent fabric to the tent support.

A28. The tent coupler of any of paragraphs A-A27, wherein the pivot interlocking member and the bridged interlocking member are configured to selectively interlock with and selectively disconnect from one another while at least one of:

(i) the tent support receiver of the bridged interlocking member is coupled to the tent support;

(ii) the tent fabric receiver of the pivot interlocking member is interconnected with the tent fabric; and (iii) a/the guy line-receiving region of the bridged interlocking member is interconnected with the guy line and the guy line is interconnected with the ground anchor.

A29. The tent coupler of any of paragraphs A-A28, wherein the pivot interlocking member is configured to selectively couple to the tent support independently of the bridged interlocking member.

A30. The tent coupler of paragraph A29, wherein the tent support is a tent pole, and wherein the bridge-receiving aperture is dimensioned and shaped to couple to a recess formed along an end region of the tent pole.

A31. The tent coupler of any of paragraphs A-A30, wherein, when the tent support receiver of the bridged interlocking member receives the tent support, the tent support receiver is configured to orient the bridged interlocking member relative to the tent support such that the bridge of the bridged interlocking member extends at least substantially normal to a length of the tent support.

B. A tent comprising:

a tent frame comprising a plurality of tent supports configured to be assembled to form an assembled tent frame, wherein the assembled tent frame is configured to support the tent on a support surface and support one or more of an inner tent fabric and an outer tent fabric spaced above the support surface;

the inner tent fabric, wherein the inner tent fabric is configured to surround an inner tent space when coupled to the assembled tent frame;

the outer tent fabric, wherein the outer tent fabric configured to surround an inner space when coupled to the assembled tent frame;

a plurality of the tent couplers of any of paragraphs A-A31, wherein each tent coupler is configured selectively couple the inner tent fabric and the outer tent fabric independently of one another to a respective tent support of the plurality of tent supports, and wherein the plurality of tent couplers is configured selectively couple the outer tent fabric and the inner tent fabric independently of one another to the assembled tent frame.

B1. The tent of paragraph B, wherein the plurality of tent supports includes a plurality of tent poles, and wherein each tent coupler of the plurality of tent couplers is configured to selectively interconnect the inner tent fabric and the outer tent fabric to an/the end region of a respective tent pole of the plurality of tent poles.

C. A method, comprising:

connecting a tent fabric to a tent support of a tent frame utilizing a tent coupler that comprises a bridged interlocking member and a pivot interlocking member, wherein the connecting comprises:

positioning the pivot interlocking member adjacent to a bridge of the bridged interlocking member, wherein the pivot interlocking member is interconnected with the tent fabric and the bridged interlocking member is coupled to the tent support;

orienting the pivot interlocking member in a linking orientation relative to the bridge;

moving the pivot interlocking member in the linking orientation relative to the bridge to translate the bridge through an entrance slot of the pivot interlocking member and into a bridge-receiving aperture of the pivot interlocking member; and pivoting the pivot interlocking member while the bridge is positioned within the bridge-receiving aperture from the linking orientation to within a range of interlocked orientations that restrict removal of the bridge from the bridge-receiving aperture.

C1. The method of paragraph C, further comprising disconnecting the tent fabric from the tent support, the disconnecting comprising:

pivoting the pivot interlocking member from within the range of interlocked orientations to the linking orientation; and moving the pivot interlocking member relative to the bridge to translate the bridge out of the bridge-receiving aperture through the entrance slot.

C2. The method of any of paragraphs C-C1, wherein the connecting further comprises coupling the tent support to a tent support receiver of the bridged interlocking member.

C3. The method of any of paragraph C2, wherein the tent fabric is an outer tent fabric and wherein the bridged interlocking member is interconnected with an inner tent fabric.

C4. The method of paragraph C3, wherein the coupling comprises connecting the inner tent fabric to the tent support.

C5. The method of any of paragraphs C3-C4, further comprising decoupling the bridged interlocking member from the tent support, wherein the decoupling comprises disconnecting the inner tent fabric from the tent support.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, "selective" and "selectively," when modifying an action, movement, configuration, or other activity of one or more components or characteristics of a tent according to the present disclosure, means that the specified action, movement, configuration, or other activity is a direct or indirect result of user manipulation of an aspect of, or one or more components of, the tent.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes an object for which at least 75% of the object is formed from the material and also includes an object that is completely formed from the material. As another example, a first direction that is at least substantially parallel to a second direction includes a first direction that forms an angle with respect to the second direction that is at most 22.5 degrees and also includes a first direction that is exactly parallel to the second direction. As another example, a first length that is substantially equal to a second length includes a first length that is at least 75% of the second length, a first length that is equal to the second length, and a first length that exceeds the second length such that the second length is at least 75% of the first length.

INDUSTRIAL APPLICABILITY

The tent couplers, tents, and methods disclosed herein are applicable to the outdoor products and tent industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, when the disclosure, the preceding numbered paragraphs, or subsequently filed claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A tent coupler configured to selectively interconnect a tent fabric and a tent support of a tent to one another, the tent coupler comprising:

a bridged interlocking member comprising:

a tent support-receiving portion comprising a tent support receiver configured to selectively couple to the tent support, a tether-receiving portion, and a bridge that extends between and supports the tent support-receiving portion and the tether-receiving portion spaced apart from one another, wherein the bridge defines a bridge width that is less than a width of each of the tent support-receiving portion and the tether-receiving portion;

a pivot interlocking member comprising a tent fabric receiver configured to interconnect with the tent fabric, wherein the pivot interlocking member defines:

a bridge-receiving aperture extending through a thickness of the pivot interlocking member and configured to selectively receive the bridge of the bridged interlocking member;

an entrance slot interconnected with the bridge-receiving aperture and configured to permit selective movement of the bridge into and out of the bridge-receiving aperture;

wherein the tent coupler is configured to selectively transition between a linking configuration and an interlocked configuration, wherein in the linking configuration, the pivot interlocking member is positioned and orientated relative to the bridged interlocking member for translation of the bridge into and from the bridge-receiving aperture via the entrance slot, and wherein in the interlocked configuration, the bridge is positioned within the bridge-receiving aperture and the pivot interlocking member is oriented within a range of interlocked orientations about the bridge that restrict removal of the bridge from the bridge-receiving aperture through the entrance slot.

2. The tent coupler of claim 1, wherein in the linking configuration, the pivot interlocking member is oriented in a linking orientation relative to the bridge, and wherein the linking orientation is outside of the range of interlocked orientations.

3. The tent coupler of claim 2, wherein the bridge of the bridged interlocking member defines a central axis that extends through the bridge perpendicular to the bridge width, wherein the pivot interlocking member is configured to pivot about the central axis to transition among the linking orientation and the range of interlocked orientations.

4. The tent coupler of claim 3, wherein the linking orientation is a first linking orientation of two linking orientations that further comprises a second linking orientation, and wherein the pivot interlocking member is pivoted 180 degrees about the central axis of the bridge from the first linking orientation to the second linking orientation.

5. The tent coupler of claim 1, wherein the pivot interlocking member comprises an interior sidewall that defines the bridge-receiving aperture and an exterior sidewall that defines an exterior of the pivot interlocking member, and wherein the entrance slot extends through the exterior sidewall and through the interior sidewall to define a passage from the bridge-receiving aperture through the exterior of the pivot interlocking member.

6. The tent coupler of claim 5, wherein in the interlocked configuration, the interior sidewall of the pivot interlocking member engages the bridge of the bridged interlocking member to restrict the bridge from being removed from the bridge-receiving aperture via the entrance slot.

7. The tent coupler of claim 5, wherein the pivot interlocking member defines an aperture axis that extends centrally through the bridge-receiving aperture parallel to the thickness of the pivot interlocking member, wherein the bridge-receiving aperture of the pivot interlocking member defines at least one aperture diameter that is measured through the aperture axis and between opposing portions of the interior sidewall of the pivot interlocking member, and wherein the at least one aperture diameter of the bridge-receiving aperture is greater than the bridge width of the bridge of the bridged interlocking member.

8. The tent coupler of claim 7, wherein the at least one aperture diameter of the bridge-receiving aperture is greater than a slot width of the entrance slot, wherein the at least one aperture diameter of the bridge-receiving aperture is less than the width of each of the tent support-receiving portion and the tether-receiving portion of the bridged interlocking member.

9. The tent coupler of claim 1, wherein the pivot interlocking member comprises a pair of opposed faces, wherein the thickness of the pivot interlocking member is measured between the pair of opposed faces, wherein the bridge of the bridged interlocking member defines a bridge length that is measured between the tent support-receiving portion and the tether-receiving portion of the bridged interlocking member, and wherein the bridge length is greater than the thickness of the pivot interlocking member.

10. The tent coupler of claim 9, wherein the tent support-receiving portion and the tether-receiving portion of the bridged interlocking member form abutting surfaces that are positioned on either side of the bridge and that extend outwardly beyond the bridge width, and wherein when bridge is positioned within the bridge-receiving aperture and the pivot interlocking member is oriented within the range of interlocked orientations about the bridge, the abutting surfaces are configured to engage the pair of opposed faces of the pivot interlocking member to prevent the pivot interlocking member from translating off of the bridge.

11. The tent coupler of claim 1, wherein the bridge of the bridged interlocking member defines a bridge length that is measured between the tent support-receiving portion and the tether-receiving portion of the bridged interlocking member, wherein the bridge of the bridged interlocking member defines a bridge thickness that is measured perpendicular to the bridge width and perpendicular to the bridge length, and wherein the bridge thickness is less than a slot width of the entrance slot of the pivot interlocking member, and wherein the bridge width of the bridge is greater than the slot width.

12. The tent coupler of claim 1, wherein the tent coupler is configured to interconnect the tent fabric to the tent support when:

(i) the tent coupler is in the interlocked configuration;

(ii) the pivot interlocking member is coupled to the tent fabric;

(iii) the bridged interlocking member is coupled to the tent support; and wherein the tent coupler is configured to selectively disconnect the tent fabric from the tent support when the tent coupler is in the linking configuration and the pivot interlocking member is disconnected from the bridged interlocking member.

13. The tent coupler claim 1, wherein the tent fabric is a first tent fabric, wherein the tent further comprises a second tent fabric, wherein the tent coupler is configured to selectively interconnect the first tent fabric and the second tent fabric to the tent support, wherein the tent coupler comprises a plurality of tent fabric receivers, wherein the tent fabric receiver is a first tent fabric receiver of the plurality of tent fabric receivers, wherein the bridged interlocking member further comprises a second tent fabric receiver of the plurality of tent fabric receivers, and wherein the second tent fabric receiver is configured to couple to the second tent fabric.

14. The tent coupler of claim 13, wherein the first tent fabric is an outer tent fabric and the second tent fabric is an inner tent fabric, and wherein the second tent fabric receiver is included in the tent support-receiving portion of the bridged interlocking member.

15. The tent coupler of claim 14, wherein the bridged interlocking member further comprises a guy line-receiving region configured to couple to a guy line, wherein the guy line is configured to interconnect the bridged interlocking member to a ground anchor that is configured to anchor the tent to a support surface, and wherein the guy line-receiving region is disposed along the tether-receiving portion of the bridged interlocking member.

16. The tent coupler of claim 1, wherein the pivot interlocking member is configured to selectively couple to the tent support independently of the bridged interlocking member, wherein the tent support is a tent pole, and wherein the bridge-receiving aperture of the pivot interlocking member is dimensioned and shaped to couple to a recess formed along an end region of the tent pole.

17. The tent coupler of claim 1, wherein the tent support is a tent pole, and wherein the bridge-receiving aperture is dimensioned and shaped to couple to a recess formed along an end region of the tent pole.

18. The tent coupler of claim 1, wherein when the tent support receiver of the bridged interlocking member receives the tent support, the tent support receiver is configured to orient the bridged interlocking member relative to the tent support such that the bridge of the bridged interlocking member extends at least substantially normal to a length of the tent support.

19. A tent comprising:

a tent frame comprising a plurality of tent supports configured to be assembled to form an assembled tent frame, wherein the assembled tent frame is configured to support the tent on a support surface and support one or more of an inner tent fabric and an outer tent fabric spaced above the support surface;

the inner tent fabric, wherein the inner tent fabric is configured to surround an inner tent space when coupled to the assembled tent frame;

the outer tent fabric, wherein the outer tent fabric configured to surround an inner space when coupled to the assembled tent frame;

a plurality of tent couplers, wherein each tent coupler of the plurality of tent couplers is the tent coupler of claim 1, wherein each tent coupler is configured selectively couple the inner tent fabric and the outer tent fabric independently of one another to a respective tent support of the plurality of tent supports, and wherein the plurality of tent couplers is configured selectively couple the outer tent fabric and the inner tent fabric independently of one another to the assembled tent frame.

20. A method, comprising:

connecting a tent fabric to a tent support of a tent frame utilizing a tent coupler that comprises a bridged interlocking member and a pivot interlocking member, wherein the connecting comprises:

positioning the pivot interlocking member adjacent to a bridge of the bridged interlocking member, wherein the pivot interlocking member is interconnected with the tent fabric and the bridged interlocking member is coupled to the tent support;

orienting the pivot interlocking member in a linking orientation relative to the bridge;

moving the pivot interlocking member in the linking orientation relative to the bridge to translate the bridge through an entrance slot of the pivot interlocking member and into a bridge-receiving aperture of the pivot interlocking member; and pivoting the pivot interlocking member while the bridge is positioned within the bridge-receiving aperture from the linking orientation to within a range of interlocked orientations that restrict removal of the bridge from the bridge-receiving aperture.

* * * * *